US009863156B1

(12) United States Patent
Barlow

(10) Patent No.: US 9,863,156 B1
(45) Date of Patent: Jan. 9, 2018

(54) SHOCK ABSORBING INTERLOCKING FLOOR SYSTEM

(71) Applicant: 308, LLC, St. Petersburg, FL (US)

(72) Inventor: David R. Barlow, Seminole, FL (US)

(73) Assignee: 308, LLC, St. Petersburg, FL (US)

( * ) Notice: Subject to any disclaimer, the term of this patent is extended or adjusted under 35 U.S.C. 154(b) by 0 days.

(21) Appl. No.: 15/462,935

(22) Filed: Mar. 20, 2017

Related U.S. Application Data

(63) Continuation-in-part of application No. 15/206,570, filed on Jul. 11, 2016, now Pat. No. 9,631,375.

(51) Int. Cl.
*E04F 15/10* (2006.01)
*E04F 15/22* (2006.01)
*E04F 15/02* (2006.01)

(52) U.S. Cl.
CPC ..... *E04F 15/225* (2013.01); *E04F 15/02005* (2013.01); *E04F 15/10* (2013.01); *E04F 2201/021* (2013.01); *E04F 2201/091* (2013.01); *E04F 2201/095* (2013.01); *E04F 2203/06* (2013.01); *E04F 2290/044* (2013.01)

(58) Field of Classification Search
CPC . E04F 15/105; E04F 15/02194; E04F 15/087; E04F 2201/091; E04F 2201/095; E04F 15/02; E01C 2201/12
See application file for complete search history.

(56) References Cited

U.S. PATENT DOCUMENTS

| | | | | |
|---|---|---|---|---|
| 609,940 | A | 8/1898 | Koehler | |
| 841,490 | A | 1/1907 | Du Montier | |
| 1,920,920 | A | 8/1933 | Venzie | |
| 2,851,134 | A | 9/1958 | Robinson, Jr. | |
| 3,077,426 | A | 2/1963 | Johnston | |
| 3,505,724 | A * | 4/1970 | Sator | A47B 91/06 16/42 R |
| 3,735,988 | A | 5/1973 | Palmer et al. | |
| 4,590,726 | A | 5/1986 | Salazar | |
| 5,163,424 | A | 9/1992 | Kohnke | |
| 5,259,758 | A | 11/1993 | Lauersdorf | |
| 6,082,886 | A | 7/2000 | Stanford | |
| 6,343,451 | B1 | 2/2002 | Chih | |
| 6,453,632 | B1 | 9/2002 | Huang | |
| 6,647,690 | B1 | 11/2003 | Martensson | |
| 6,751,912 | B2 * | 6/2004 | Stegner | E01C 5/20 52/177 |
| 6,793,586 | B2 | 9/2004 | Barlow et al. | |
| D499,189 | S | 11/2004 | Collison | |
| 6,862,857 | B2 | 3/2005 | Tychsen | |

(Continued)

*Primary Examiner* — Rodney Mintz
*Assistant Examiner* — Daniel Kenny
(74) *Attorney, Agent, or Firm* — Larson & Larson, P.A.; Frank Liebenow; Patrick Reid

(57) ABSTRACT

Interlocking panels have a top portion and side edges. Multiple panels are interlocked together mechanically along the side edges by locking features. The top portion includes a substantially planar top surface, side edges, and interlocking features. The bottom support structure is made of a shock absorption material that fits under the substantially planar top surface, thereby providing support and cushioning to the substantially planar top surface. The interlocking feature includes, for example, sides alternating between sides that have protrusions (upward or downward) and sides that have receivers for the protrusions.

20 Claims, 31 Drawing Sheets

(56) References Cited

U.S. PATENT DOCUMENTS

| | | | | |
|---|---|---|---|---|
| 6,922,965 | B2 | 8/2005 | Rosenthal et al. | |
| 6,968,663 | B2 | 11/2005 | Thiers et al. | |
| 7,003,924 | B2 | 2/2006 | Kettler et al. | |
| D530,835 | S | 10/2006 | Rosine et al. | |
| 7,287,357 | B2 | 10/2007 | Gomez Insa | |
| 7,299,592 | B2 | 11/2007 | Moiler, Jr. | |
| 7,340,865 | B2 | 3/2008 | Vanderhoef | |
| 7,487,622 | B2 | 2/2009 | Wang | |
| 7,516,587 | B2 | 4/2009 | Barlow | |
| 7,610,655 | B2 * | 11/2009 | Thaw | A47B 91/066 16/30 |
| 7,698,859 | B2 | 4/2010 | Sansano Marti | |
| 7,757,449 | B2 | 7/2010 | Portales Ibanez et al. | |
| 7,930,865 | B2 | 4/2011 | Barlow | |
| 8,353,640 | B2 | 1/2013 | Sawyer | |
| 8,397,456 | B2 | 3/2013 | Ruhdofer | |
| 8,662,787 | B2 | 3/2014 | Sawyer et al. | |
| 8,668,403 | B2 | 3/2014 | Sawyer | |
| 8,827,590 | B2 | 9/2014 | Sawyer et al. | |
| 8,967,905 | B2 | 3/2015 | Sawyer et al. | |
| 8,967,906 | B2 | 3/2015 | Sawyer | |
| 2002/0083673 | A1 | 7/2002 | Kettler et al. | |
| 2002/0189176 | A1 | 12/2002 | Stegner et al. | |
| 2003/0009971 | A1 | 1/2003 | Palmberg | |
| 2005/0016098 | A1 | 1/2005 | Hahn | |
| 2005/0028475 | A1 | 2/2005 | Barlow et al. | |
| 2005/0066606 | A1 | 3/2005 | Dolinski | |
| 2006/0070314 | A1 | 4/2006 | Jenkins et al. | |
| 2006/0272252 | A1 | 12/2006 | Moiler, Jr. | |
| 2006/0283127 | A1 | 12/2006 | Pervan | |
| 2007/0163195 | A1 | 7/2007 | Jenkins et al. | |
| 2007/0214741 | A1 | 9/2007 | Llorens Miravet | |
| 2007/0289236 | A1 | 12/2007 | Choi | |
| 2008/0010928 | A1 | 1/2008 | Moriau et al. | |
| 2008/0092473 | A1 | 4/2008 | Heyns | |
| 2008/0127593 | A1 | 6/2008 | Janesky | |
| 2008/0168730 | A1 | 7/2008 | Pervan et al. | |
| 2008/0168736 | A1 | 7/2008 | Pervan | |
| 2015/0176225 | A1 | 6/2015 | Sawyer | |
| 2015/0267357 | A1 | 9/2015 | Sawyer et al. | |

* cited by examiner

SHOCK ABSORBING INTERLOCKING FLOOR SYSTEM

CROSS-REFERENCE TO RELATED APPLICATION

This application is a continuation-in-part of U.S. patent application Ser. No. 15/206,570, filed Jul. 11, 2016, the disclosure of which is hereby incorporated by reference.

FIELD OF THE INVENTION

The present invention relates to flooring and floor base systems. More particularly, it refers to multi-sectional interlocking panels designed to form a floor surface or under laying surface.

BACKGROUND OF THE INVENTION

Surface coverings, such as synthetic grass, carpet, linoleum, wood flooring, rubberized flooring system, and tile, need to be laid over a base that will support the surface covering. Commonly, surface coverings are laid over a base of compacted stone, asphalt, plywood, or cement. These base materials are expensive to install, and, once installed, are difficult to remove. Recreational surfaces frequently need to be moved to different locations because the same site is often used for different activities, such as an ice rink converted to a basketball court or concert stage. A need exists for an inexpensive, permanent or easily movable base surface or stand-alone floor surface that provides structural support while &so providing adequate fall-height protection for athletes, animals, children, etc.

U.S. Pat. No. 7,516,587 to Barlow describes an "Interlocking Floor System," and is hereby incorporated by reference. This application describes polymeric panels that can be assembled into a floor system. Such panels are described as having an internal grid system beneath the surface for maintaining structure under the weight of people and objects.

Prior panels were either molded of a plastic material with a support structure (e.g. a grid) beneath the panels to provide rigidity or were formed entirely of foam or rubber; the latter were often used to cover sports fields, playgrounds, etc. Often the foam or rubber panels were made of polypropylene foam, polyethylene foam, or rubber, to help absorb the shock of a being impacting the surface.

What is needed is an interlocking panel that has the rigidity of plastic panels and the shock absorbing properties of foam or rubber panels.

SUMMARY OF THE INVENTION

This application describes interlocking panels attachable by locking features to create an indoor/outdoor floor system or floor system base. The interlocking panels are prepared by compression, blow, injection, or any other molding process to prepare a planar top surface. A shock absorption material is then attached to form a support structure beneath the planar top surface, providing a top planar surface that has a selectable amount of rigidity to provide structural support, while resilient by way of the resiliency of the shock absorption material, thereby providing proper fall/impact protection. Interlock features mounted at sides of each interlocking panel provide for connecting to adjacent interlocking panels, forming a large surface area. The interlocked panels are easily assembled and later disassembled if needed.

In one embodiment, interlocking panels for a floor system base are disclosed. The panels include a top portion that has a substantially planar top surface and has side surfaces. The top portion has features for interlocking with other interlocking panels; the features for interlocking are located on at least one of the side surfaces. The interlocking panels have bottom support structures filling an underside of the top portion, thereby providing support and shock absorption to the planar top surface.

In another embodiment, an interlocking panel for a floor system base is disclosed including a top portion that has a substantially planar top surface and side surfaces. The top portion has features for interlocking to other panels on at least one of the side surfaces. The interlocking panel has a bottom support structure comprised of a shock absorption material that provides support and shock absorption to the substantially planar top surface.

In another embodiment, an interlocking panel for a floor system base is disclosed including a top portion made or molded from one or more materials selected from polypropylene, structural urethane foams, polyolefin, filled plastic, phenolic, stiff rubber, aluminum, metal, and alloys. The top portion has a substantially planar top surface and side surfaces; at least one of the side surfaces has a device for interlocking with other panels. A bottom support structure is made of a shock absorption material selected from, for example, polypropylene foam, expanded polypropylene foam, polyethylene foam, expanded polyethylene foam, polystyrene foam, expanded polystyrene foam, urethane foam, rubber, and processed recycled rubber. The bottom support structure provides support and shock absorption to the substantially planar top surface.

In another embodiment, an interlocking panel for a floor system base is disclosed including a top portion having a substantially planar top surface and side surfaces. The side surfaces depend downward from the planar top surface forming a cavity in an underside of the substantially planar top surface. At least one of the side surfaces has downward facing protrusions and at least one other of the side surfaces has receivers for interlocking of adjacent interlocking panels. A bottom support structure, fills the cavity, thereby providing support and shock absorption to the substantially planar top surface.

In another embodiment, an interlocking panel for a floor system base is disclosed including a top portion having a substantially planar top surface and side surfaces. The side surfaces depend downward from the planar top surface forming a cavity in an underside of the substantially planar top surface. At least one of the side surfaces has protrusions and at least one other of the side surfaces has receivers for interlocking with the protrusions of an adjacent interlocking panel. A bottom support structure made from a shock absorbing material is held within the cavity for providing support and shock absorption to the substantially planar top surface.

In another embodiment, an interlocking panel for a floor system base is disclosed including a top portion made or molded from one or more materials selected from polypropylene, structural urethane foams, polyolefin, filled plastic, phenolic, stiff rubber, aluminum, metal, and alloys. The top portion has a substantially planar top surface and side surfaces depending downwardly from edges of the substantially planar top surface forming a cavity beneath the substantially planar top surface The top portion has mechanisms for interlocking situated on at least one of the side surfaces. The mechanisms for interlocking include protrusions and receivers. A bottom support structure is made of a shock absorption material selected from, for example, polypropylene foam, expanded polypropylene foam, polyethylene foam, expanded polyethylene foam, polystyrene foam, expanded polystyrene foam, urethane foam, rubber, and processed recycled rubber. The bottom support structure provides support and shock absorption to the substantially planar top surface.

BRIEF DESCRIPTION OF THE DRAWINGS

The invention can be best understood by those having ordinary skill in the art by reference to the following detailed description when considered in conjunction with the accompanying drawings in which.

DETAILED DESCRIPTION OF THE INVENTION

Figure 1:
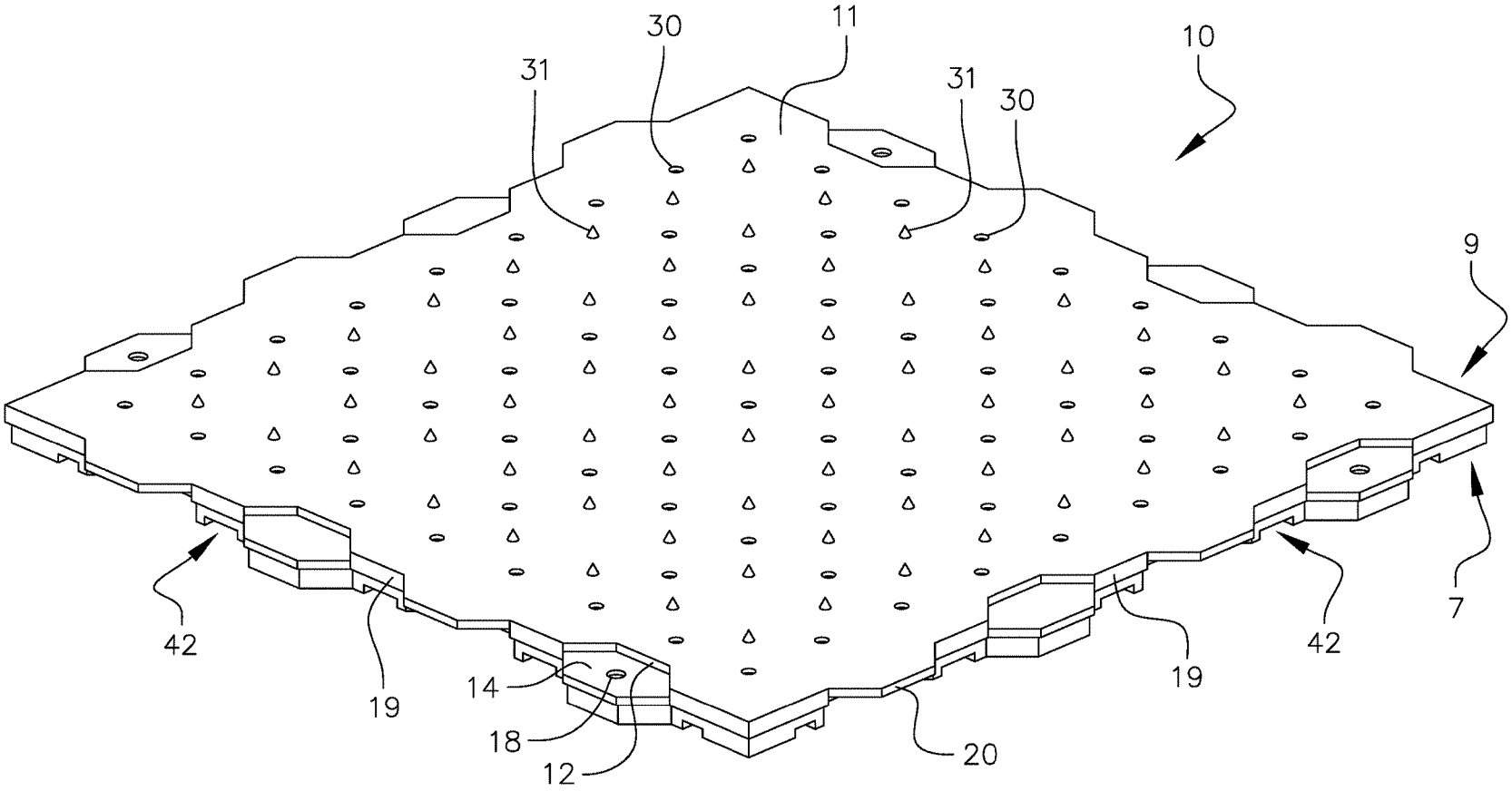
FIG. 1 illustrates a top isometric assembled top planar surface and the bottom support structure.

Reference will now be made in detail to the presently preferred embodiments of the invention, examples of which are illustrated in the accompanying drawings. Throughout the following detailed description, the same reference numerals refer to the same elements in all figures.

Throughout this description, the covering material is shown as an example, as it is fully anticipated that the panels have no covering material or any covering material, including, but not limited to carpet, linoleum, vinyl, wood, synthetic wood, ceramic tile, plastic tile, artificial turf, synthetic grass, etc. In some embodiments, the covering material is or includes organic material such as grass, sod, plants, etc.

Throughout the description, it is described that the top portion of the panels are made or molded from plastic, rubber, or stamped metal (e.g. aluminum). Although there is no limitation to the type of plastic, metal, rubber, and/or polymers that are anticipated, examples include, but are not limited to, polypropylene, structural urethane foams other suitable commercially available polyolefin, filled plastic, phenolic, stiff rubber, aluminum, metal, alloys, etc. In some embodiments, the top portion is a polymer sprayed onto the bottom portion, for example, ⅛" thick sprayed polypropylene or polyurethane.

Throughout the description, it is described that the bottom support structure of the interlocking panels are made from a shock absorbing material. Although there is no limitation to the type of shock absorbing material, example shock absorption materials include, but are not limited to, polypropylene foam, expanded polypropylene foam, expanded polyethylene foam, polyethylene foam, expanded polystyrene foam, expanded urethane foam and/or rubber such as processed recycled rubber.

Throughout this description, a typical shape is used to describe features and edges. For example, the drainage holes in the panels are shown as having a circular cross-section, though there is no limitation on the shape and/or size of such drainage holes. Likewise, the interlocking panels are shown having a generally rectangular or square outer shape, though, again, there is no limitation as to the outer shape geometry of the interlocking panels, as any other overall geometric shape is equally anticipated, for example, triangular, etc.

Although one method of manufacturing the interlocking panels is by molding the top section and molding the bottom section, then joining the top section and the bottom section, any method of manufacturing is anticipated, including, but not limited to molding both the top and bottom sections at one time, stamping the top section from sheet metal, die cutting, etc.

Figure 2:
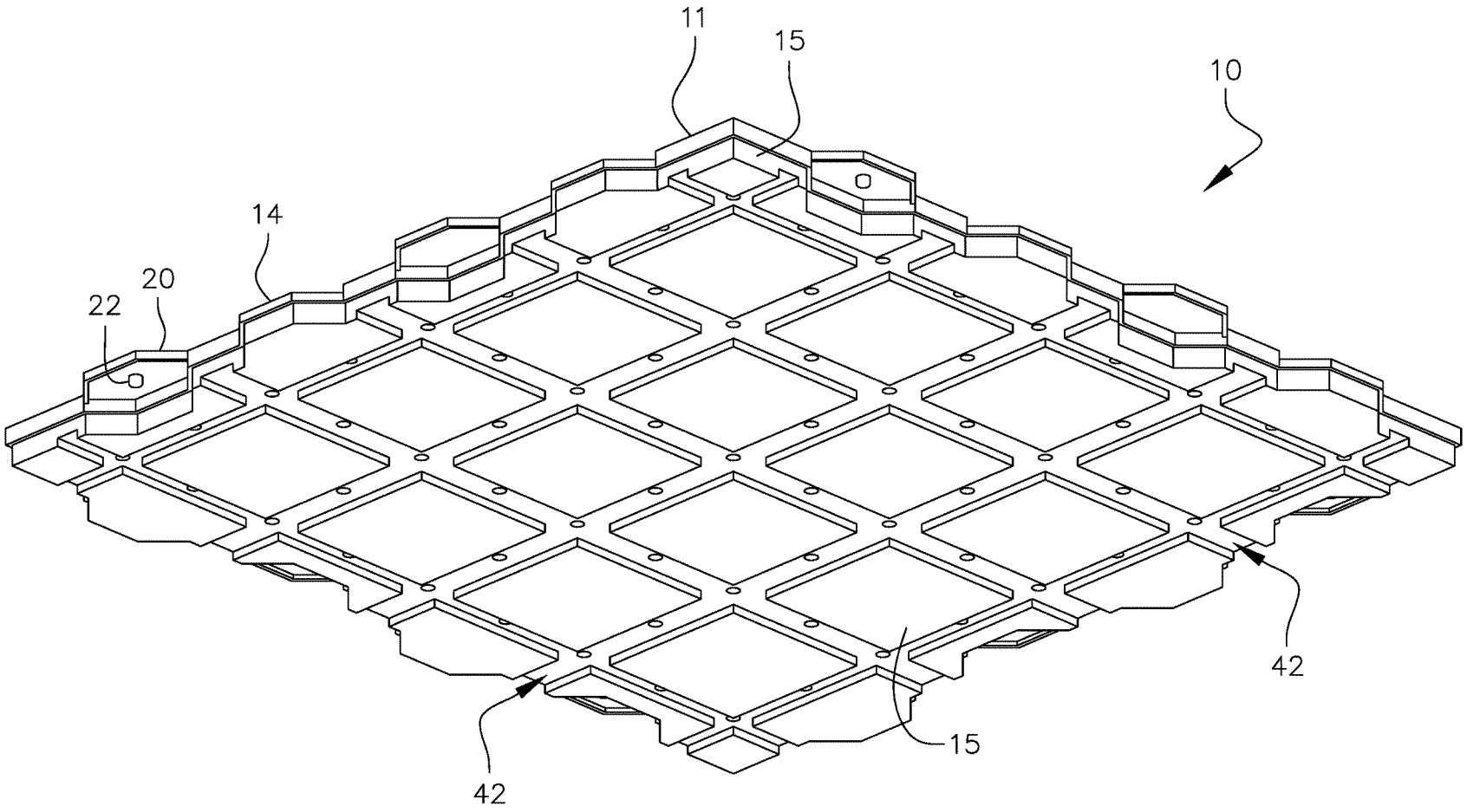
FIG. 2 illustrates a bottom isometric assembled top planar surface and the bottom support structure.

Referring to FIGS. 1 and 2, interlocking panels 10 are shown. Each interlocking panel 10 includes a top portion 9, having a top surface 11 that, preferably, is planar. The planar top surface 11, side surfaces 19, and interlock mechanisms 12/14/18/20/22 are rigid to semi-rigid (e.g. bends slightly under force). In some embodiments, the top portion 9 is molded from a material that provides the rigid or semi-rigid substantially planar top surface 11, for example, polypropylene, structural urethane foams, polyolefin, filled plastic, phenolic, stiff rubber, aluminum, metal, alloys. In some embodiments, the top portion 9 is a polymer sprayed onto the bottom portion 7, for example, a ⅛" thick spray of polypropylene or polyurethane.

Supporting the top surface 11 is a bottom support structure 7 bonded/held thereto, having a bottom 15. The bottom support structure 7 is made of a shock absorption material that provides support and resiliency to the top surface 11. Although any resilient shock absorption material is anticipated, in some embodiments, the shock absorption material is polypropylene foam, expanded polypropylene foam, polyethylene foam, polystyrene foam, urethane foam and/or rubber such as processed recycled rubber. In one example, recycled foam is used.

In some embodiments, the planar top surface 11 includes projections 31. For example, pointy projections 31 as shown for reducing sideways movement of a covering material 60 such as artificial turf, carpet, etc. (see FIGS. 6 and 7).

In some embodiments, one or more drainage holes 30 are provided in the top surface 11 for drainage. Liquids (e.g. rain, water, etc.) that fall on the surface 11, drain through the drainage holes 30. Some of this liquid percolates down into the sub-surface, while in some embodiments, troughs 42 are formed in the bottom support structure 7. In such, it is preferred that the drainage holes 30 are fluidly interfaced to the troughs 42. As it will be shown, the troughs 42 of one interlocking panel 10 are preferably fluidly interfaced with troughs 42 of adjacent interlocking panels 10, permitting the flow of the fluids between interlocking panels 10.

Although many panel interlock mechanisms are anticipated, the interlock mechanism of FIGS. 1 and 2 include upward facing steps 14 and downward facing steps 20. In one embodiment, at least one of the downward facing steps 20 contains a downwardly pointing projection 22 (e.g., convex projection) on a downwardly facing surface as shown in FIG. 2. In such embodiments, at least one of the upward facing steps 14 contains a mating depression 18 (e.g. dimple) on an upwardly facing surface. It is fully anticipated that, alternately, the downwardly pointing projection 22 be on the upward facing step 14 and the mating depression 18 be on the downward facing step 20.

Also, in such embodiments, it is anticipated that the depression 18 is larger than the downwardly pointing projection 22 to provide for a small amount of lateral movement to provide for expansion and contraction as temperatures vary.

Figure 3:
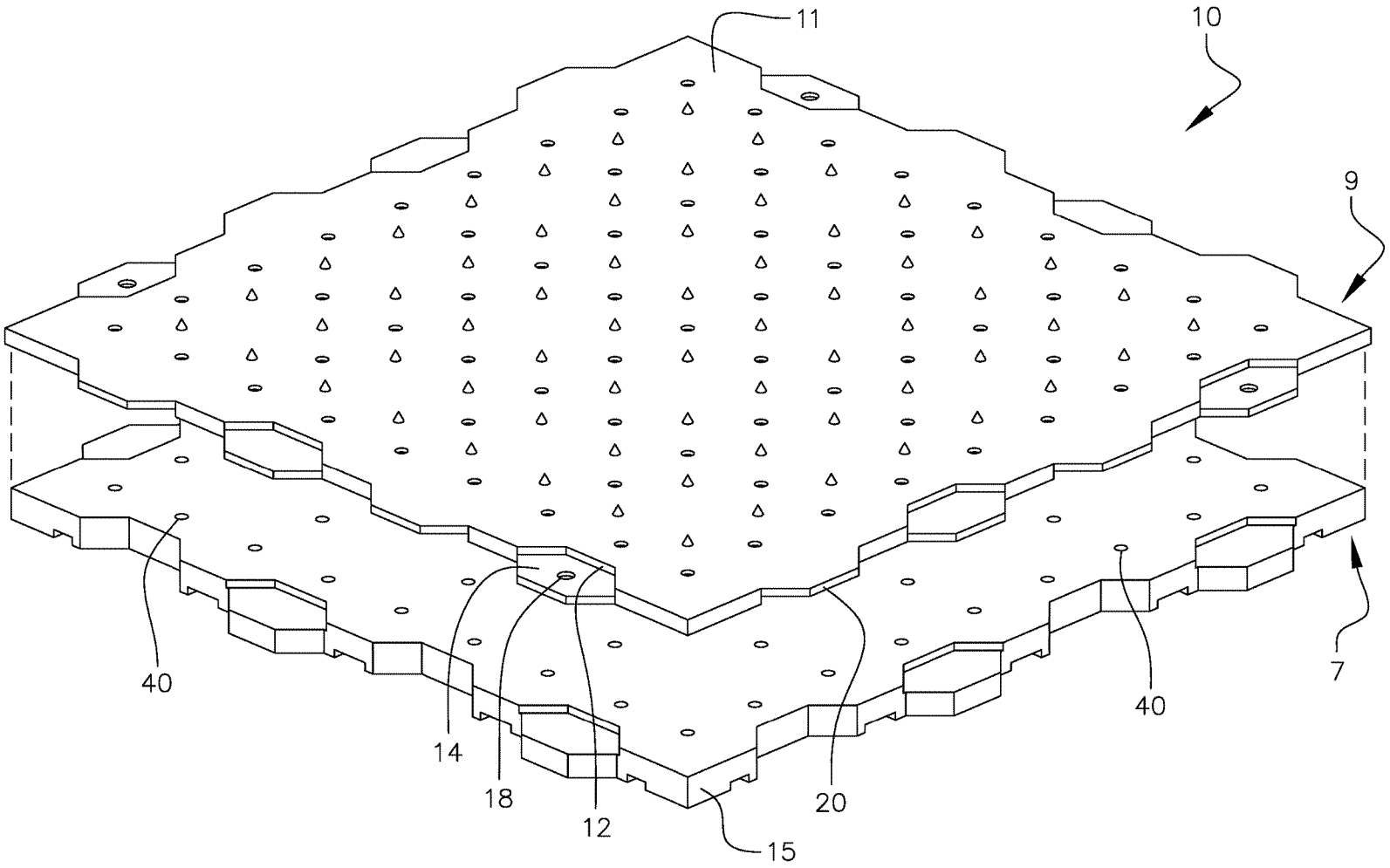
FIG. 3 illustrates a top isometric exploded top planar surface and the bottom support structure.
Figure 4:
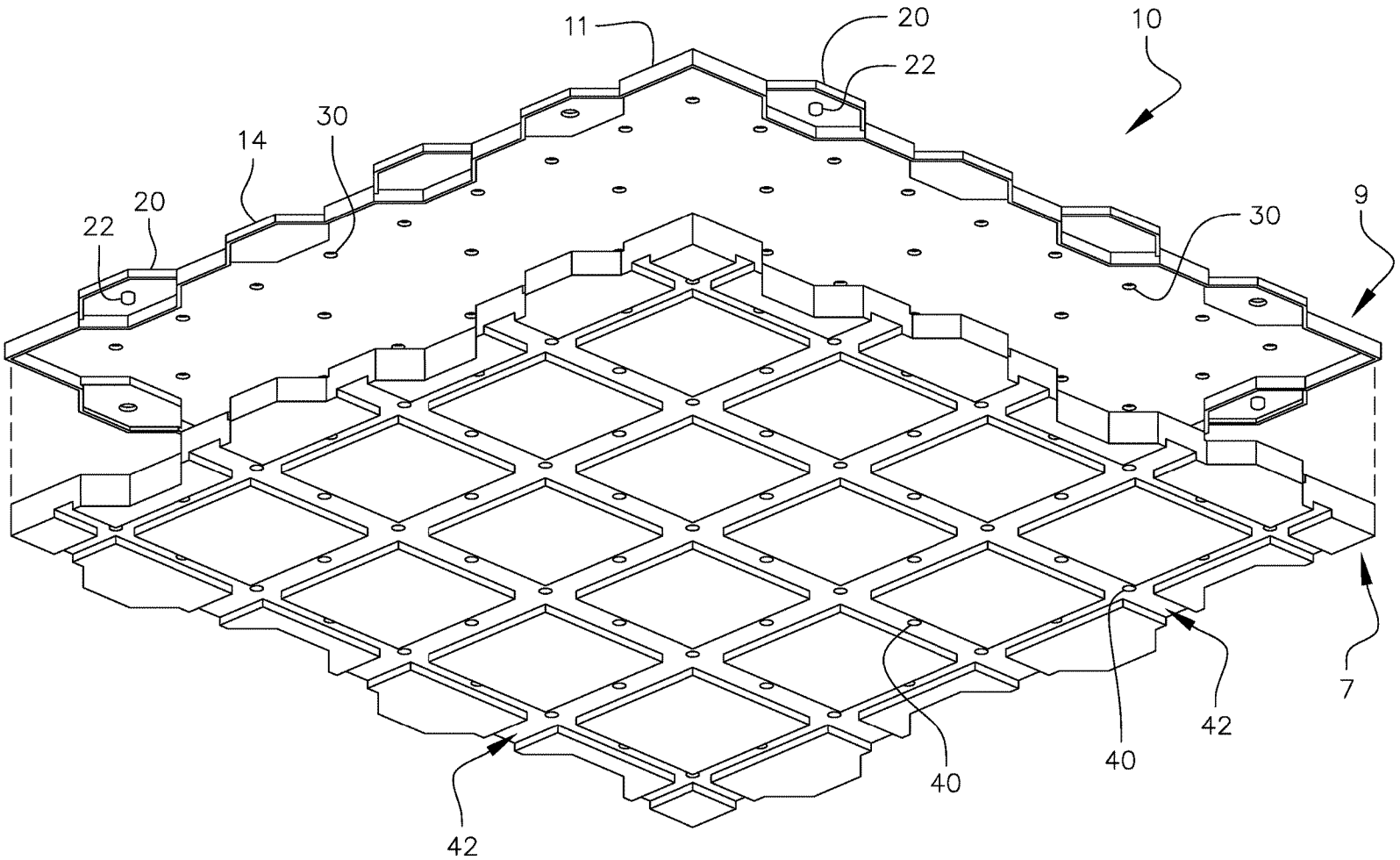
FIG. 4 illustrates a bottom isometric exploded top planar surface and the bottom support structure.

Referring to FIGS. 3 and 4, top and bottom isometric exploded views of the top portion 9 and the bottom support structure 7 are shown. In these views, the top portion 9 is separated from the bottom support structure 7. The bottom support structure 7 includes holes 40 that are aligned with the drainage holes 30 of the top planar surface 11, so as to provide drainage through both the top portion 9 and the bottom support structure 7.

In some embodiments, the top portion 9 is held to the bottom support structure 7 by an adhesive between the top portion 9 and the bottom support structure 7. In some embodiments, the top portion 9 is held to the bottom support structure 7 by molding the bottom support structure 7 directly within the top portion 9. In some embodiments, the bottom support structure 7 is held to an undersurface of the top portion 9 by features on the undersurface of the top portion 7 such as barbs.

Figure 5:
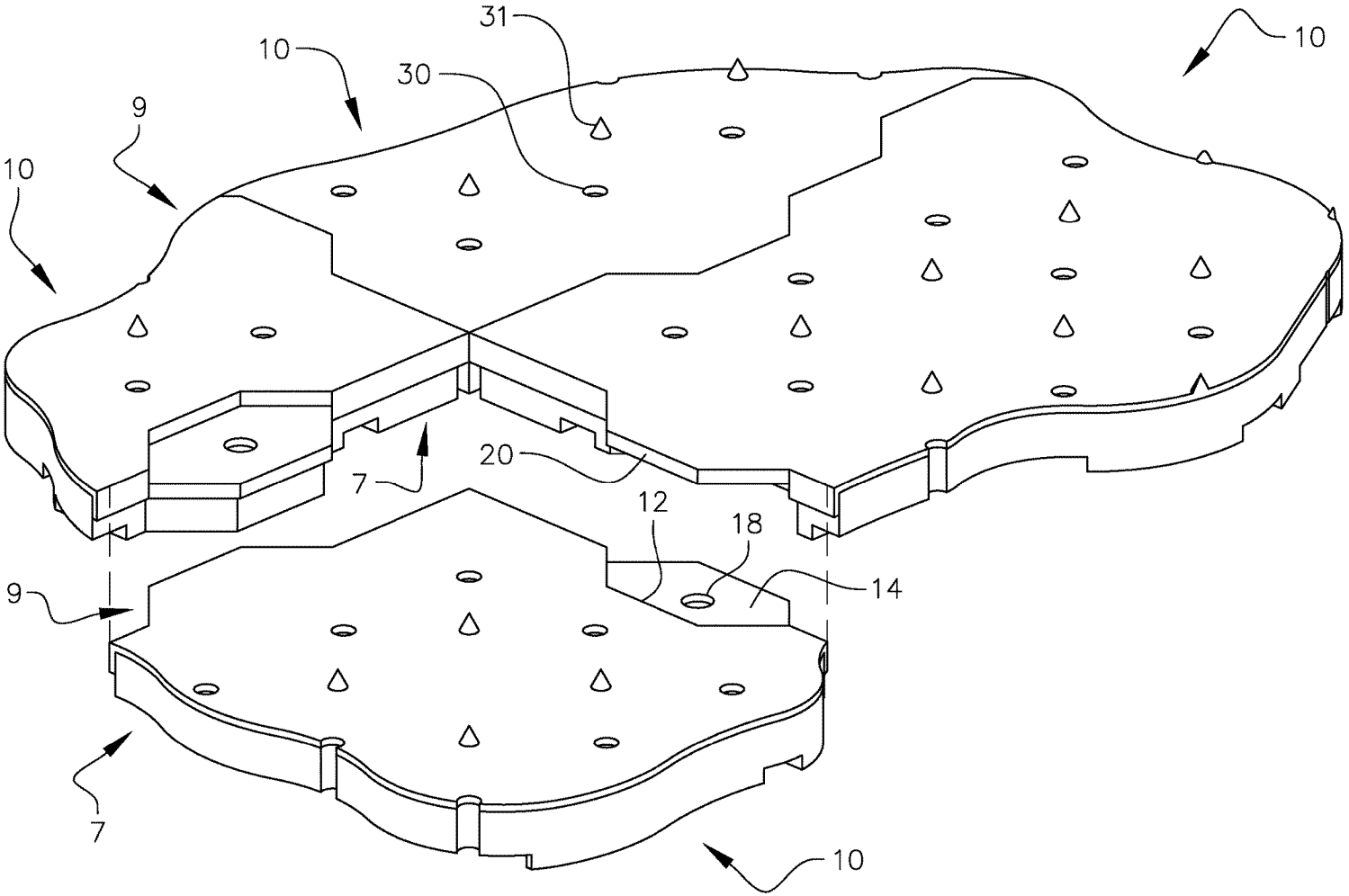
FIG. 5 illustrates a top isometric of a multiple panel assembly.

Referring to FIG. 5, a top isometric view of multiple interlocking panel 10 assemblies is shown. To cover larger areas, multiple interlocking panels 10 are joined along their edges, the upward facing steps 14 and downward facing steps 20 mating and interlocking by way of the downwardly pointing projection 22 on the downward facing steps 20 mating with the mating depressions 18 of the upward facing steps 14, holding the adjacent interlocking panels 10 together.

Figure 6:
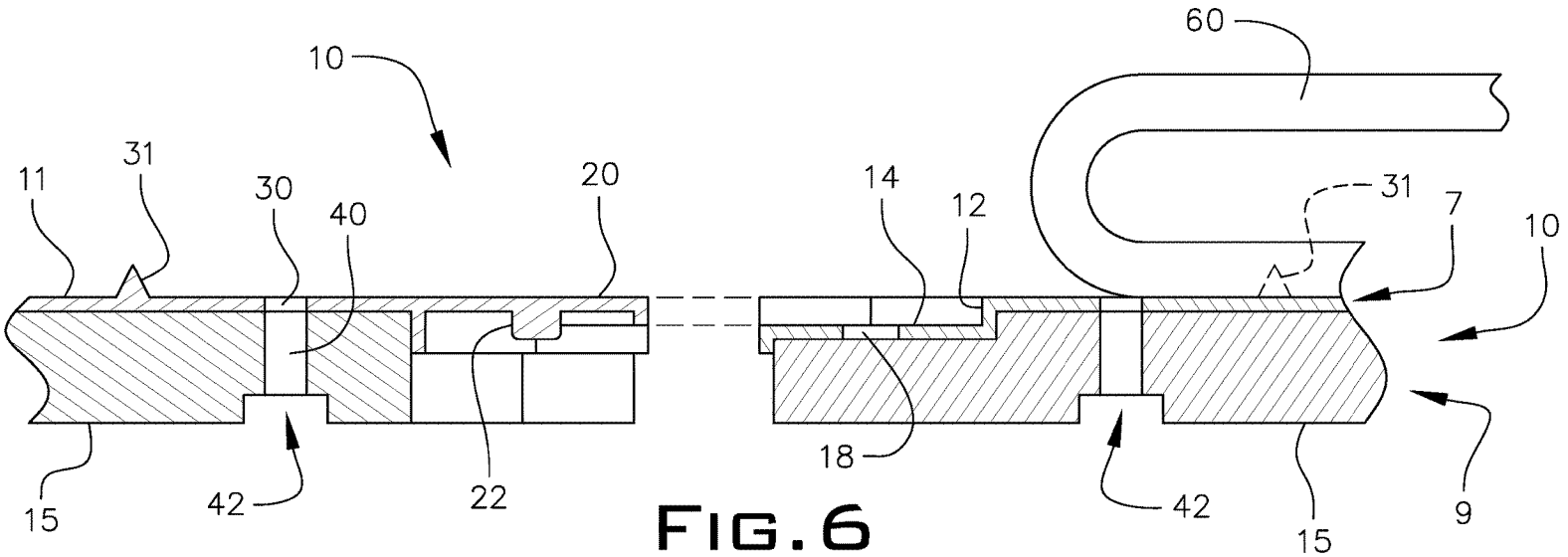
FIG. 6 illustrates a cross section of two panels prior to assembly with cover material rolled back.
Figure 7:
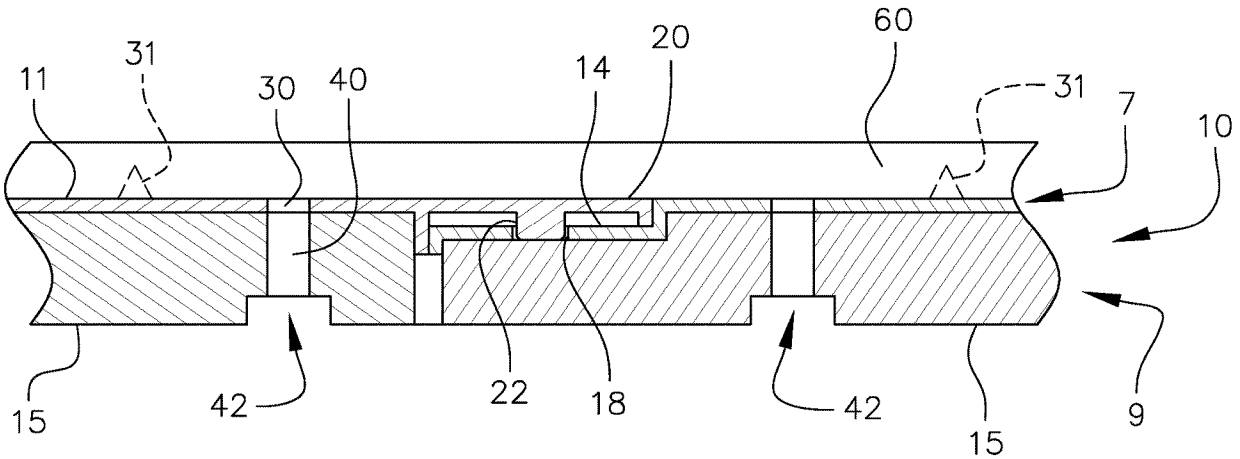
FIG. 7 illustrates a cross section of two panels assembled with cover material.
Figure 8:
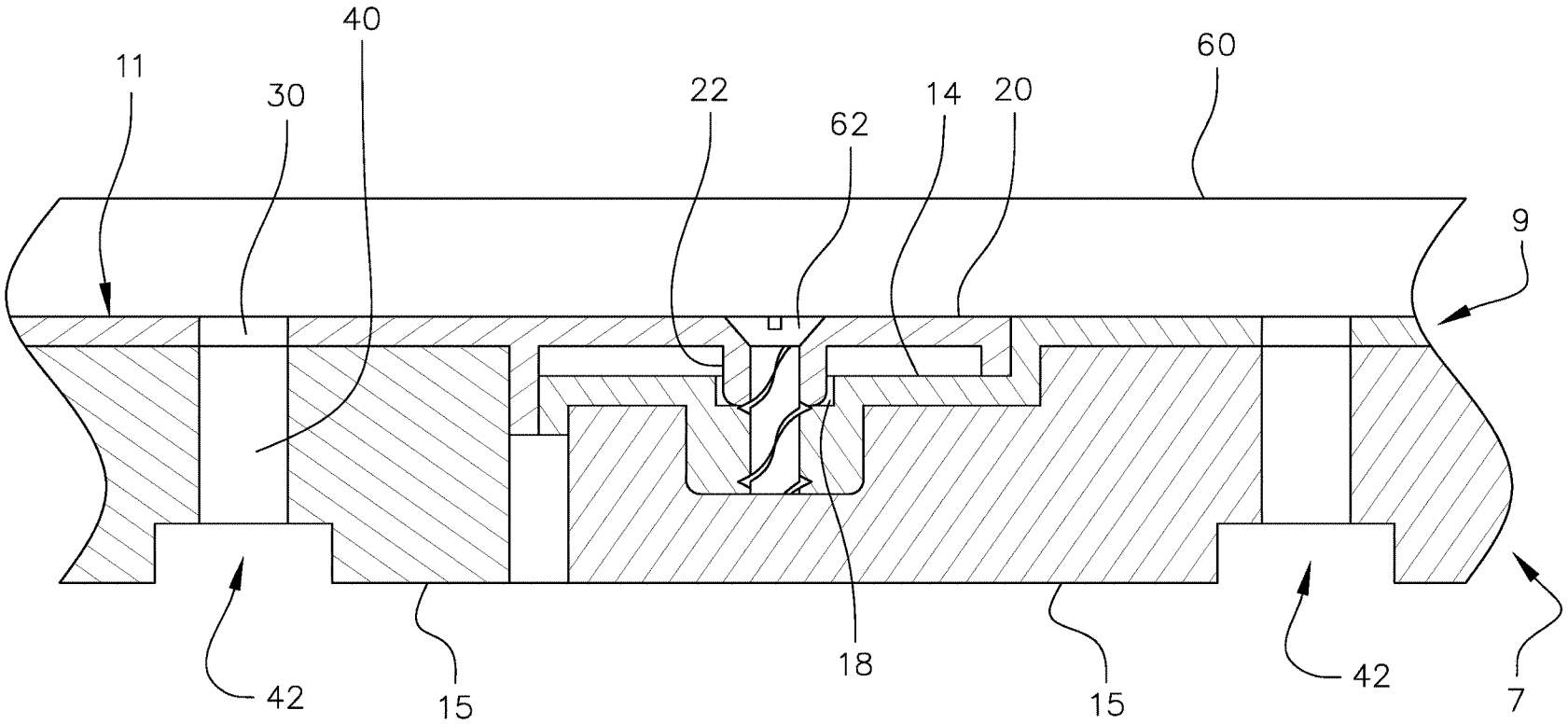
FIG. 8 illustrates a cross section of two panels assembled with cover material and optional fastener.

Referring to FIGS. 6 and 7, cross section views of two interlocking panels 10 are shown prior to assembly with the cover material 60 rolled back in FIG. 6 and assembled with cover material 60 in place in FIG. 7. In FIG. 7, the upward facing step 14 is moving under the downward facing steps 20. In FIG. 8, the upward facing step 14 is under the downward facing steps 20 and held together by the downwardly pointing projection 22 on the downward facing steps 20 mating into the depression 18 of the upward facing steps 14. Any shape of downwardly pointing projection 22 and depression 18 is anticipated.

The cover material 60 is any covering material such as carpet, linoleum, vinyl, wood, synthetic wood, ceramic tile, plastic tile, artificial turf, synthetic grass, etc. In embodiments in which the top surface 11 includes projections 31 (e.g. barbs), the projections 31 increase friction between the bottom surface of the cover material 60 and the top planar surface 11, thereby reducing lateral slippage of the cover material 60 as lateral forces are applied to the cover material 60.

Referring to FIG. 8, a cross section of two interlocking panels 10 assembled with cover material 60 and an optional fastener 62. In this embodiment, the upward facing step 14 is mated with the downward facing steps 20 and held together both by the downwardly pointing projection 22 on the downward facing steps 20 mating into the depression 18 of the upward facing steps 14. Additional support and strength is provided from a fastener 62 (shown as a screw). Although the fastener 62 is shown as a screw, any fastener 62 is anticipated including, but not limited to, a pin, a nail, a spike, etc. In FIG. 8, the cover material 60 is in place.

Figure 9:
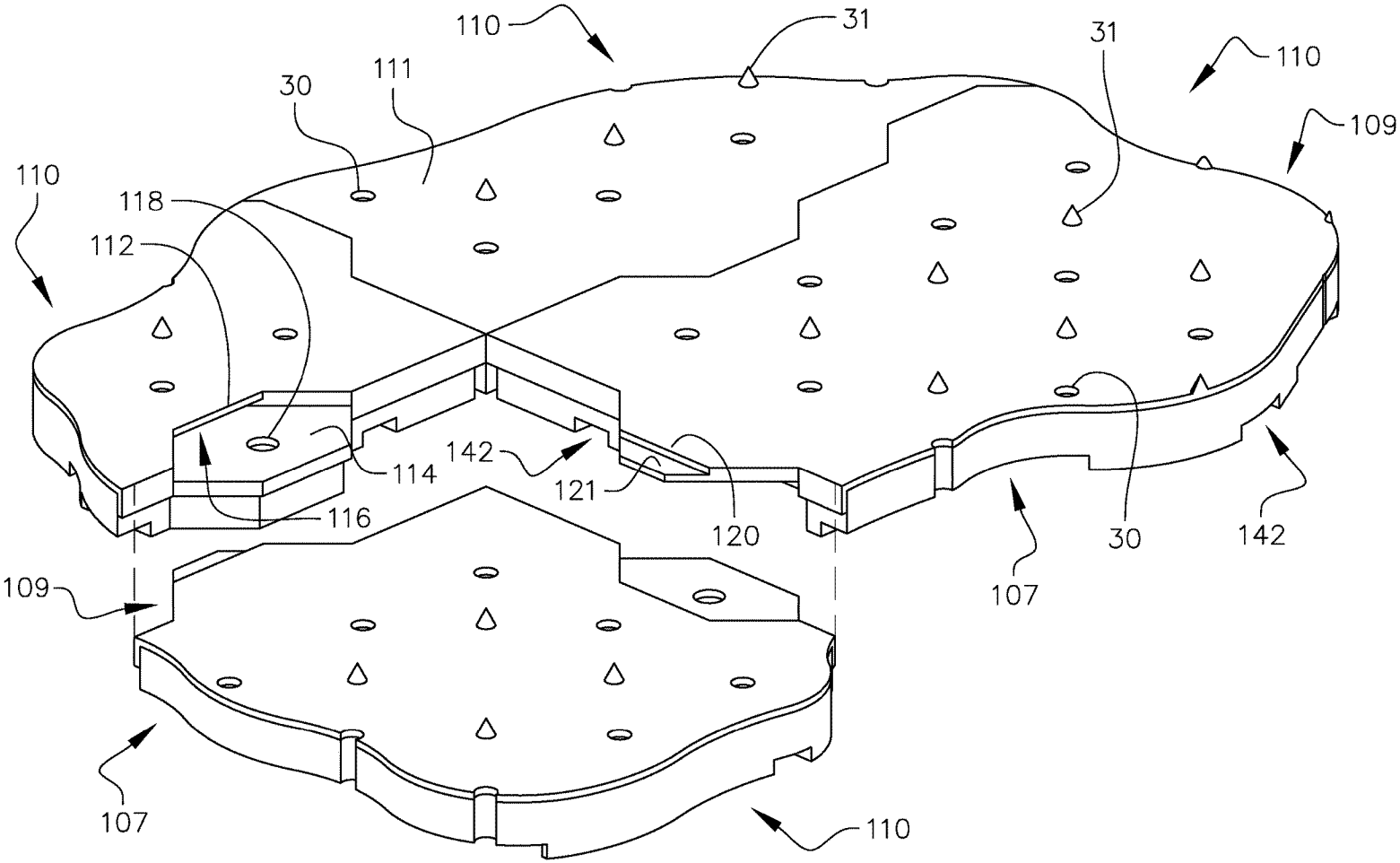
FIG. 9 illustrates a top isometric multiple assembly with male protrusions and female recesses.
Figure 10:
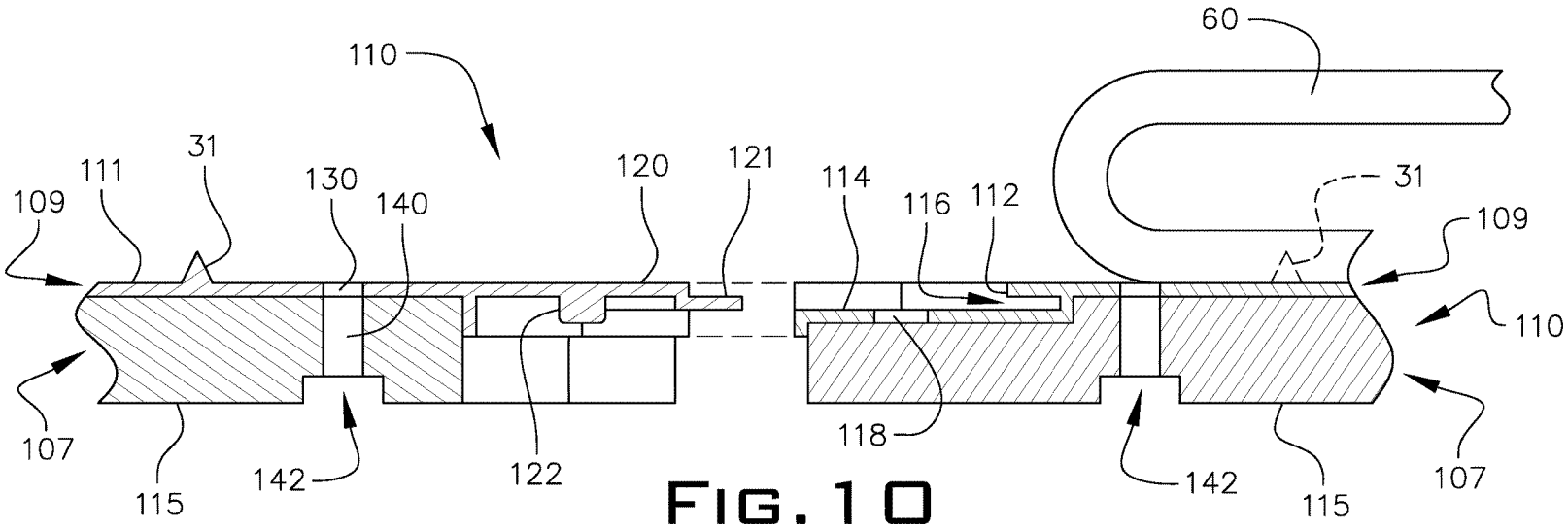
FIG. 10 illustrates a cross section of two panels prior to assembly with cover material rolled back.
Figure 11:
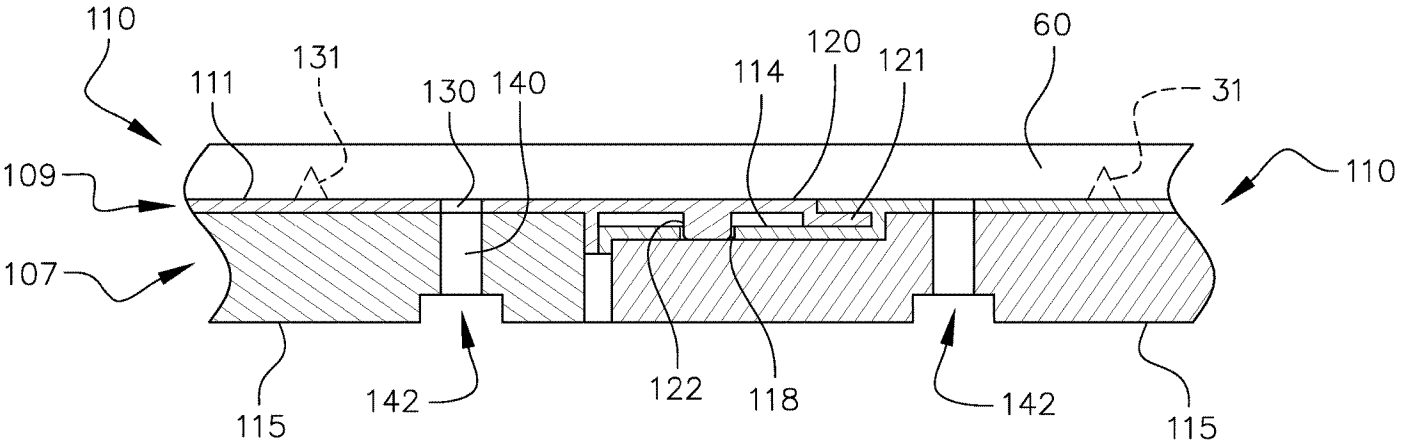
FIG. 11 illustrates a cross section of two panels assembled with cover material.

Referring to FIGS. 9, 10, and 11 multiple assemblies of interlocking panels 110 are shown with a slightly modified interlocking mechanism that includes male protrusions and female recesses. In FIG. 10 a cross section of the multiple assemblies of interlocking panels 110 are shown prior to assembly with the cover material 60 rolled back, while in FIG. 11 a cross section of the two interlocking panels 110 are shown assembled with the cover material 60.

The interlocking panel 110 has under hang ledges 121 to allow the downward facing steps 120/121 to be inserted so that the under hang ledge 121 slides into a cavity 116 formed between the upward facing steps 114 and an overhang ledge 112, thereby engaging the projections 122 with depressions 118. The overhang ledge 112 is a continuation of the planar top surface 111 of the interlocking panel 110. Such an interlock mechanism helps adjacent interlocking panels 110 retain planar alignment while providing a tight mechanical interlock.

Again, the bottom support structure 107 is made of a shock absorption material that provides support and resiliency to the top surface 111.

In embodiments with interlocking panels 110 that have more than one pair of steps, it is preferred to configure the interlocking panels 110 as shown alternating the upward facing steps 114 with the downward facing steps 120/121. In some embodiments, the downward facing steps 120/121 have projections 122 (e.g. convex projections) and the upward facing steps 114 have mating depressions 118 (e.g. concave dimples). In some embodiments, the downward facing steps 120/121 have depressions 118 and the upward facing steps 114 have mating projections 122. In an alternate embodiment, the upward facing steps 114 are in a different order and do not alternate with the downward facing steps 120/121. In some embodiments, the depressions 118 are larger in cross-sectional size (e.g. diameter) than the projections 122, allowing for lateral movement of panels as the panels expand/contract due to environmental conditions such as heating/cooling.

In some embodiments a fastener 62 is included to better hold the interlocking panels 110 together.

It is anticipated that the interlocking panels 110 are disengaged by pulling them apart, overcoming the force of the concave mating dimples 118 and the convex projections 122.

In one embodiment, the top portion 109 of the interlocking panel 110 is molded from plastic as an integral rigid body and the bottom support structure 107 is made of a shock absorption material that provides support and resiliency to the planar top surface 111. In some embodiments, the planar top surface 111 is coated with a material such as carpet, linoleum, vinyl, wood, synthetic wood, ceramic tile, plastic tile, artificial turf, etc. In some embodiments, the interlocking panels 110 are not covered (e.g. no cover 60) and in some embodiments, an area cover is affixed after the interlocking panels 110 are installed and interlocked.

Also, in some embodiments, the planar top surface 111 includes one or more optional projections 31 and/or one or more optional drainage holes 30. The projections 31, such as pointy projections as shown, reduce sideways movement of a covering material 60 such as carpet, linoleum, vinyl, wood, synthetic wood, ceramic tile, plastic tile, artificial turf, synthetic grass, etc. The drainage holes 30 are provided in the planar top surface 111 for drainage. Liquids (e.g. rain, water, etc.) that fall on the planar top surface 111, drain through the drainage holes 30. Some of this liquid percolates down into the sub-surface, while in some embodiments, troughs 142 are formed in the bottom support structure 107. In such, it is preferred that the drainage holes 30 are fluidly interfaced to the troughs 142. As it will be shown, the troughs 142 of one interlocking panel 110 are fluidly interfaced with troughs 142 of adjacent interlocking panels 110, permitting the flow of the fluids between interlocking panels 110.

In FIG. 10, the upward facing step 114 is moving under the downward facing steps 120/121. In this view, the overhang ledge 112 is shown as well as the under hang ledge 121. As the interlocking panels 110 are pushed together as shown in FIG. 11, the under hang ledge 121 snuggly fits between the overhang ledge 112 and the upward facing step 114, holding the interface between adjacent interlocking panels 110 flat together as shown in FIG. 11. In some embodiments, the downward facing steps 120/121 is held within this cavity 116 between the upward facing step 114 and the overhang ledge 112 by the downwardly pointing projection 122 on the downward facing steps 120/121 mating into the mating depression 118 of the upward facing steps 114 or vice versa.

The cover material 60 is any covering material such as carpet, linoleum, vinyl, wood, synthetic wood, ceramic tile, plastic tile, artificial turf, synthetic grass, etc. In embodiments in which the planar top surface 111 includes projections 31 (e.g. barbs), the projections 31 increase friction between the bottom surface of the cover material 60 and the planar top surface 111, thereby reducing lateral slippage of the cover material 60 as lateral forces are applied to the cover material 60. In some embodiments, there is no cover material 60 and the planar top surface 111 provides the walking/playing surface.

Figure 12:
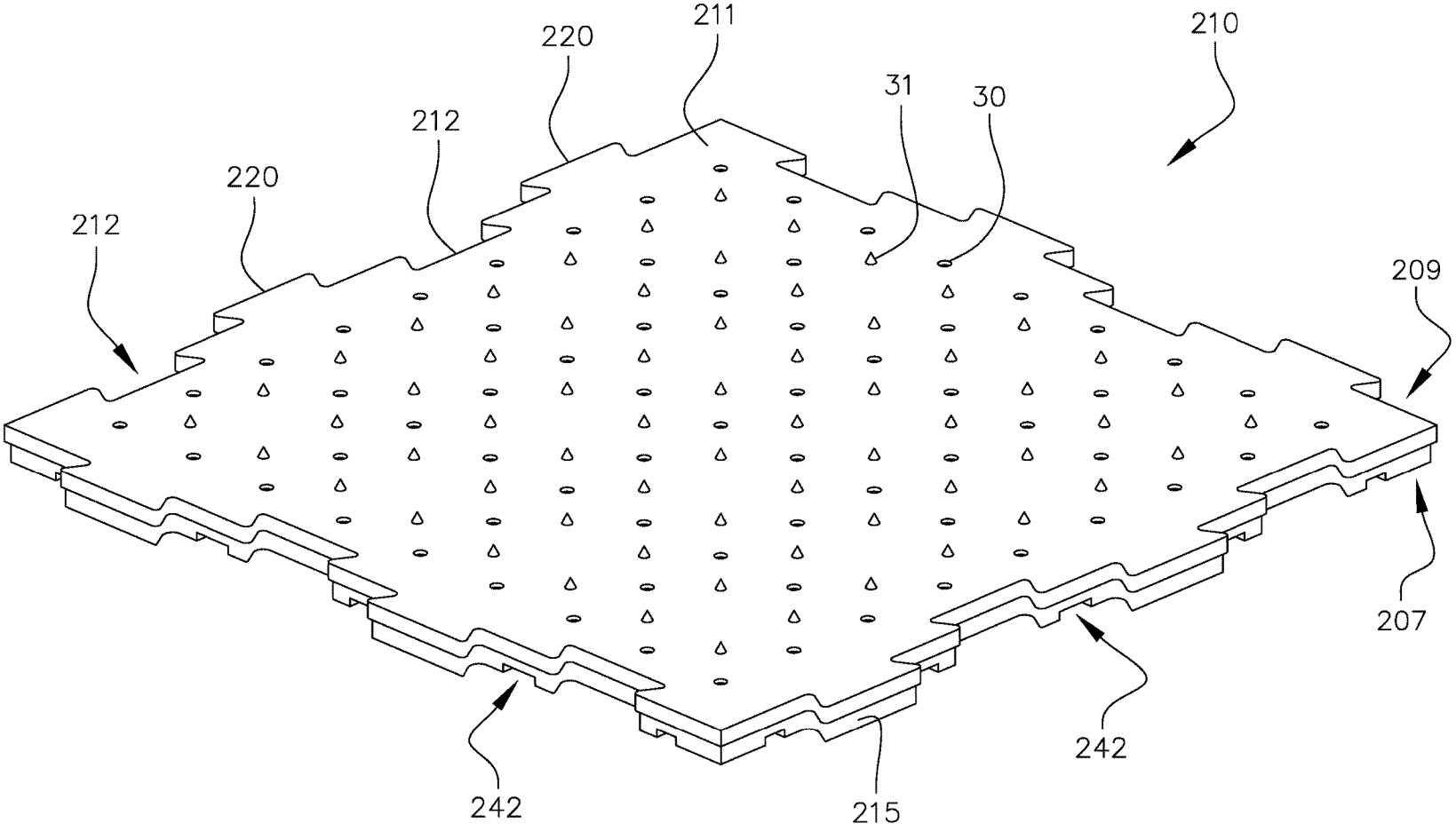
FIG. 12 illustrates a top isometric assembled top planar surface and the bottom support structure (dovetail design).
Figure 13:
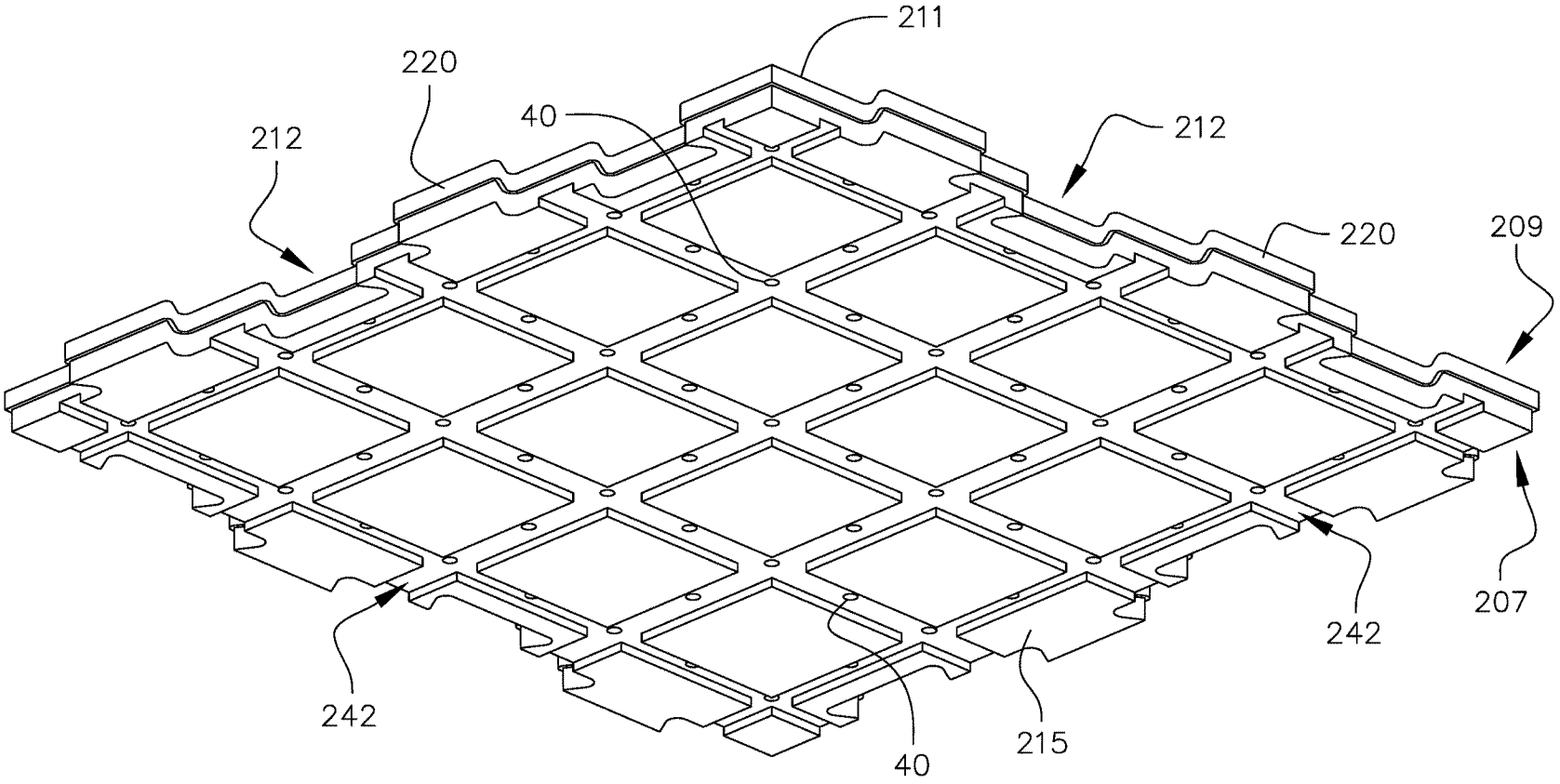
FIG. 13 illustrates a bottom isometric assembled top planar surface and the bottom support structure (dovetail design).
Figure 14:
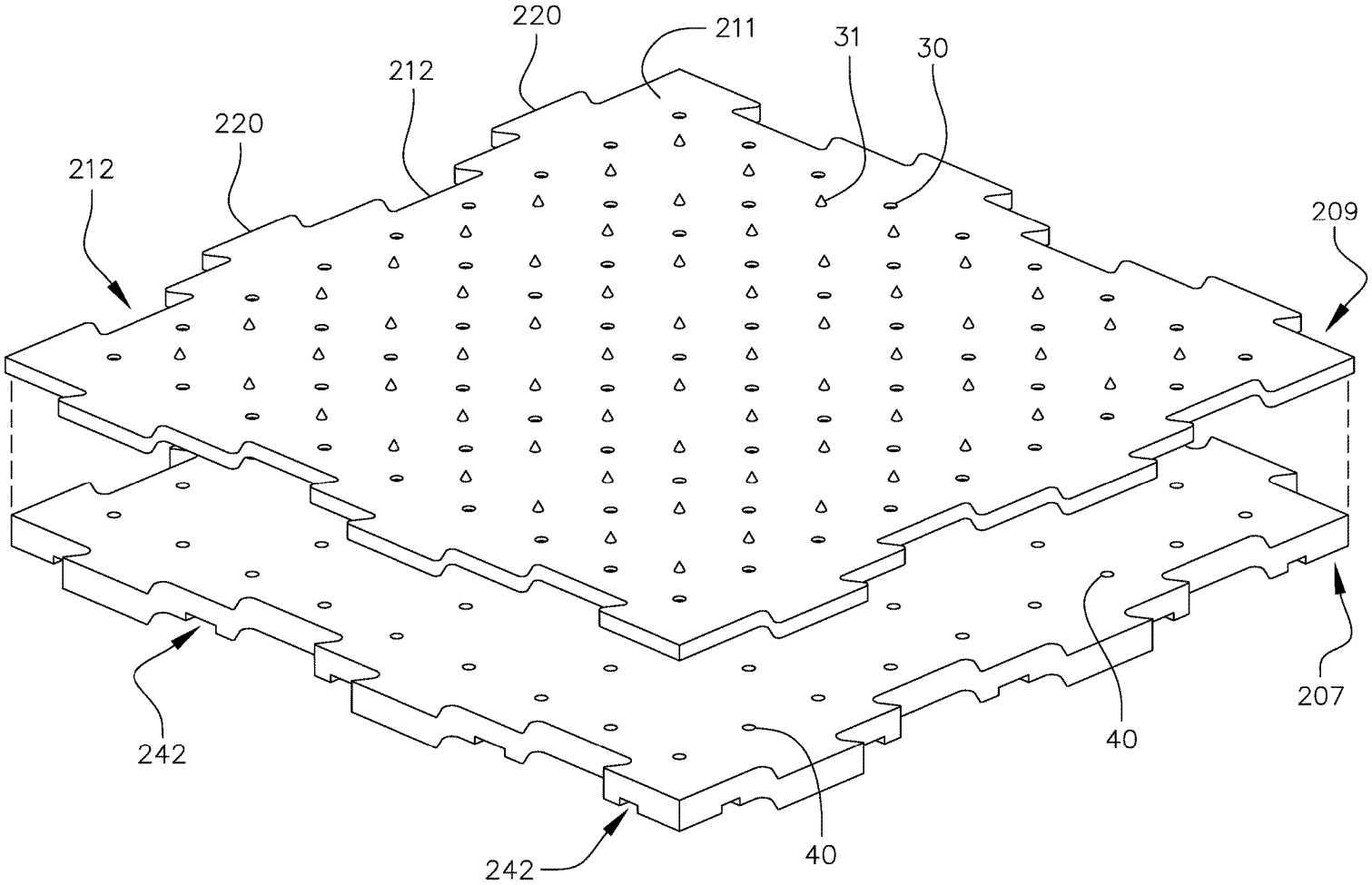
FIG. 14 illustrates a top isometric exploded top planar surface and the bottom support structure (dovetail design).
Figure 15:
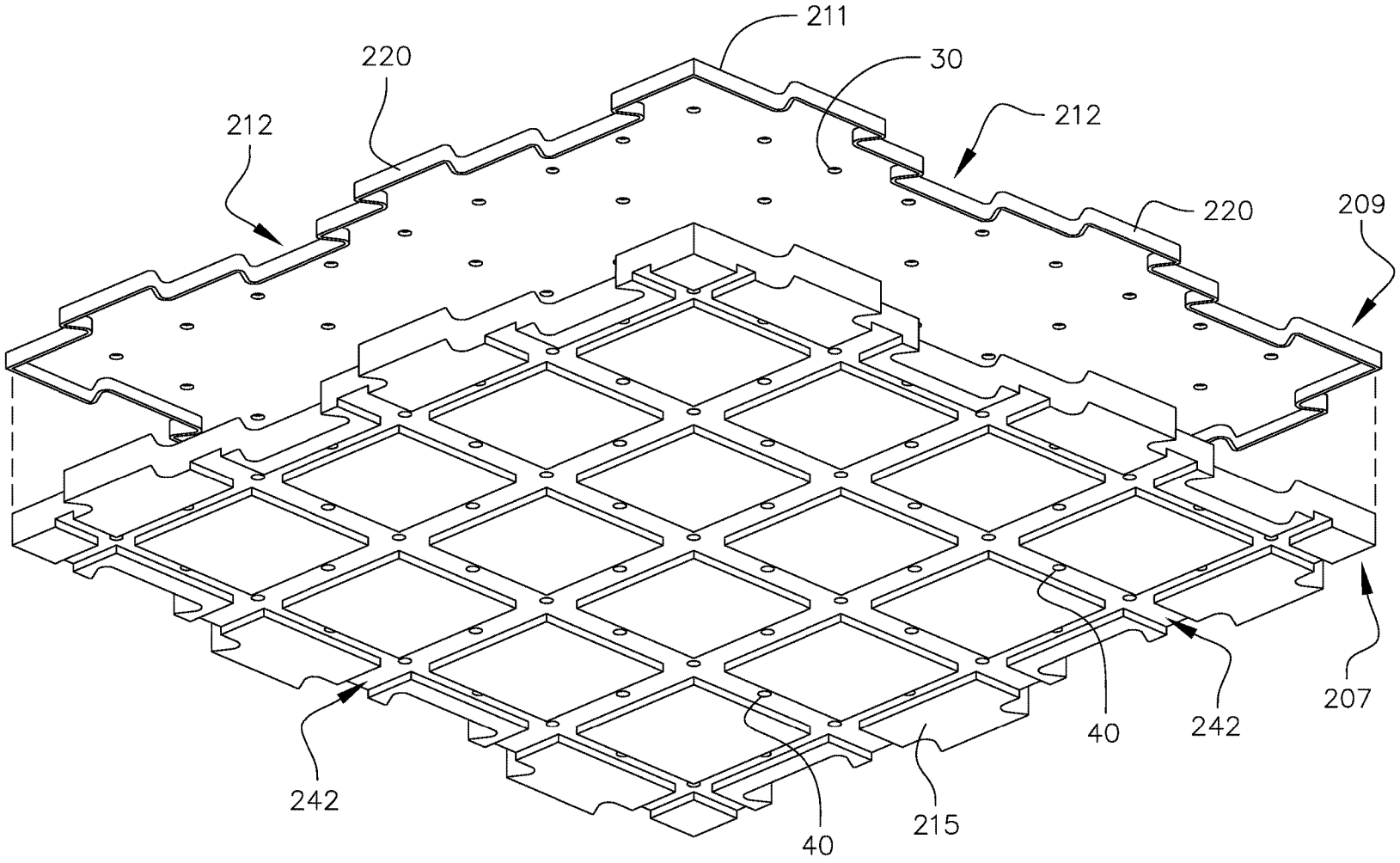
FIG. 15 illustrates a bottom isometric exploded top planar surface and the bottom support structure (dovetail design).

Referring to FIGS. 12-15, views of another interlocking panel 210 having keyed (dovetail design) attachment mechanism is shown. In FIG. 12, a top isometric of the interlocking panel 210 is shown with the top portion 209 assembled to the bottom support structure 207. In FIG. 13, a bottom isometric of the assembled interlocking panel 210 is shown. In FIG. 14, a top isometric exploded view of the interlocking panel 210 is shown with the top portion 209 and the bottom support structure 207 separated. In FIG. 15, a bottom isometric exploded view of the interlocking panel 210 is shown with the top portion 209 and the bottom support structure 207 separated.

In some embodiments, the top portion 209 (includes top planar surface 211, side walls, and keyed interlocking features 212/214/218/220) is molded from a plastic or rubber material, and/or formed/stamped from a metal, providing the rigid or semi-rigid top surface 211. Any suitable material(s) is anticipated such as plastic, filled plastic, phenolic, stiff rubber, aluminum, metal, and alloys, etc.

Supporting the planar top surface 211 is a bottom support structure 207 bonded or held thereto. The bottom support structure 207 is made of a shock absorption material that provides support and resiliency to the top surface 211. Although any resilient shock absorption material is anticipated, in some embodiments, the shock absorption material is polypropylene foam, expanded polypropylene foam, polyethylene foam, polystyrene foam, urethane foam and/or rubber such as processed recycled rubber.

In some embodiments, the planar top surface 211 includes projections 31 such as pointy projections as shown for reducing sideways movement of a covering material 60 such as artificial turf, carpet, etc.

In some embodiments, one or more drainage holes 30 are provided in the top surface 211 for drainage. Liquids (e.g. rain, water, etc.) that fall on the surface 211, drain through the drainage holes 30. Some of this liquid percolates down into the sub-surface, while in some embodiments, troughs 242 are formed in the bottom support structure 215. In such, it is preferred that the drainage holes 30 are fluidly interfaced to the troughs 242. As it will be shown, the troughs 242 of one interlocking panel 210 are fluidly interfaced with troughs 242 of adjacent interlocking panels 210, permitting the flow of the fluids between interlocking panels 210.

Although many panel interlock mechanisms are anticipated, the interlock mechanism of FIGS. 12-15 includes keyed projections 220 and keyed projection receivers 212. The keyed projections 220 are located so they align with and interface into keyed projection receivers 212 of adjacent interlocking panels 210. In some embodiments, the keyed projection receivers 212 are larger than the keyed projections 220, allowing for lateral movement of panels as the panels expand/contract due to environmental conditions such as heating/cooling.

Referring to FIGS. 14 and 15, top and bottom isometric exploded views of the top planar surface 211 and the bottom support structure 215 are shown. In these views, the top portion 209 is separated from the bottom support structure 207. The bottom support structure 207 includes holes 40 that are aligned with the drainage holes 30 of the top planar surface 211, so as to provide drainage through both the top portion 209 and the bottom support structure 207.

In some embodiments, the panels are manufactured with an adhesive between the top portion 209 and the bottom support structure 207. In some embodiments, the panels are manufactured by molding the bottom support structure 207 directly within the bottom area of the top portion 209. In some embodiments, the bottom support structure 207 is held to an undersurface of the top portion 209 by features on the undersurface of the top portion 209 such as barbs.

Figure 16:
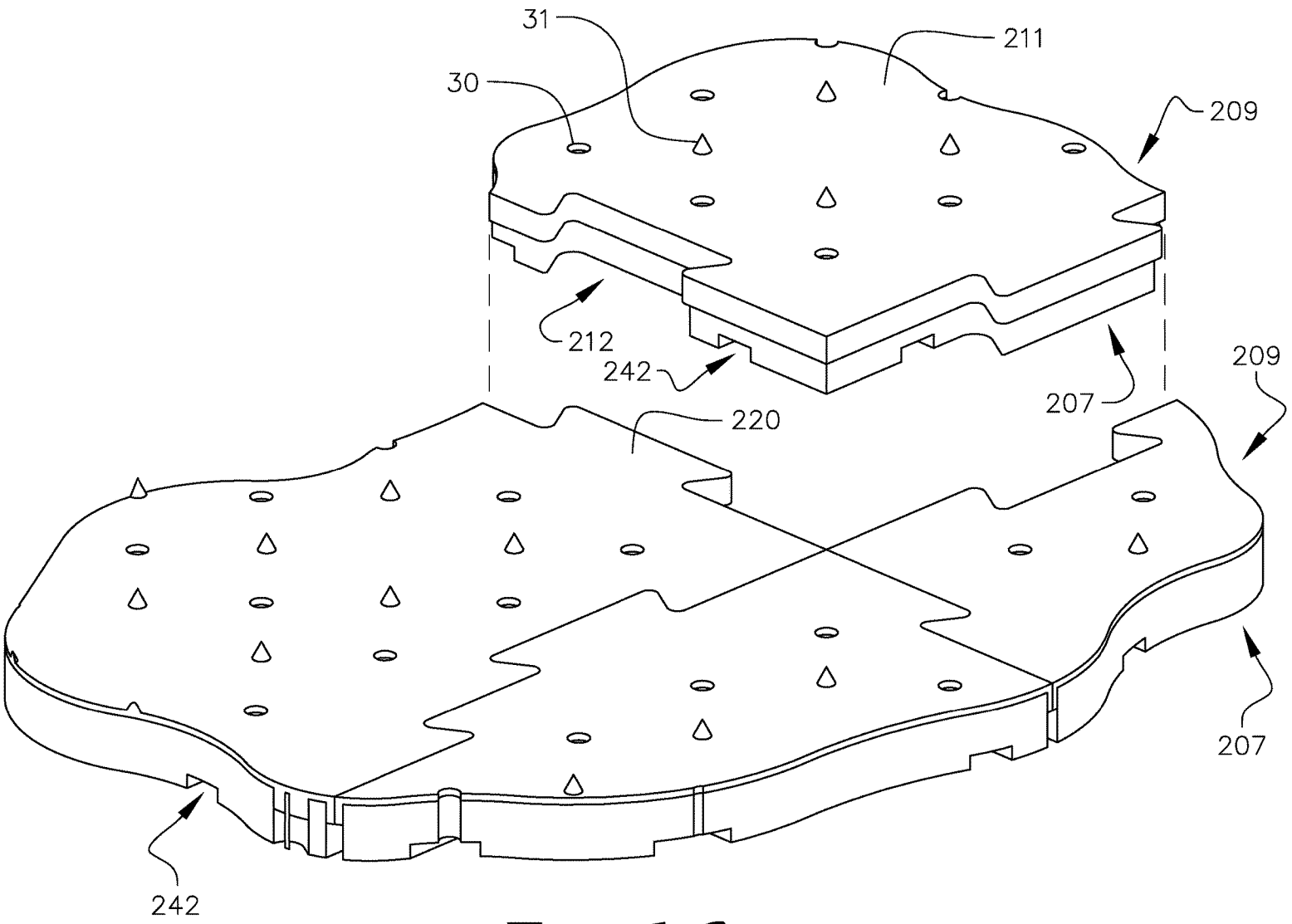
FIG. 16 illustrates a top isometric multiple panel assembly (dovetail design).

Referring to FIG. 16, a top isometric showing multiple interlocking panels 210 assembled using the keyed projections 220 and keyed projection receivers 212. In this, the multiple interlocking panels 210 are assembled by aligning the keyed projections 220 of one interlocking panel 210 with keyed projection receivers 212 of an adjacent interlocking panel 210 and pressing the keyed projections 220 into the keyed projection receivers 212, similar to a jigsaw puzzle.

As these interlocking panels 210 are often used to form a walking surface, it is anticipated that a force of greater weight will often be asserted on one interlocking panel 210 than on an adjacent interlocking panel 210 (e.g. a person steps on one interlocking panel 210, but not the adjacent interlocking panel 210). To limit skewing of the interlocking panels 210, in some embodiments, a panel locking mechanism 250/252 as shown in FIGS. 17 and 18 is employed.

It is also anticipated that in some embodiments, the keyed projection receivers 212 are larger than the keyed projections 220, allowing for lateral movement of panels as the panels expand/contract due to environmental conditions such as heating/cooling.

Figure 18:
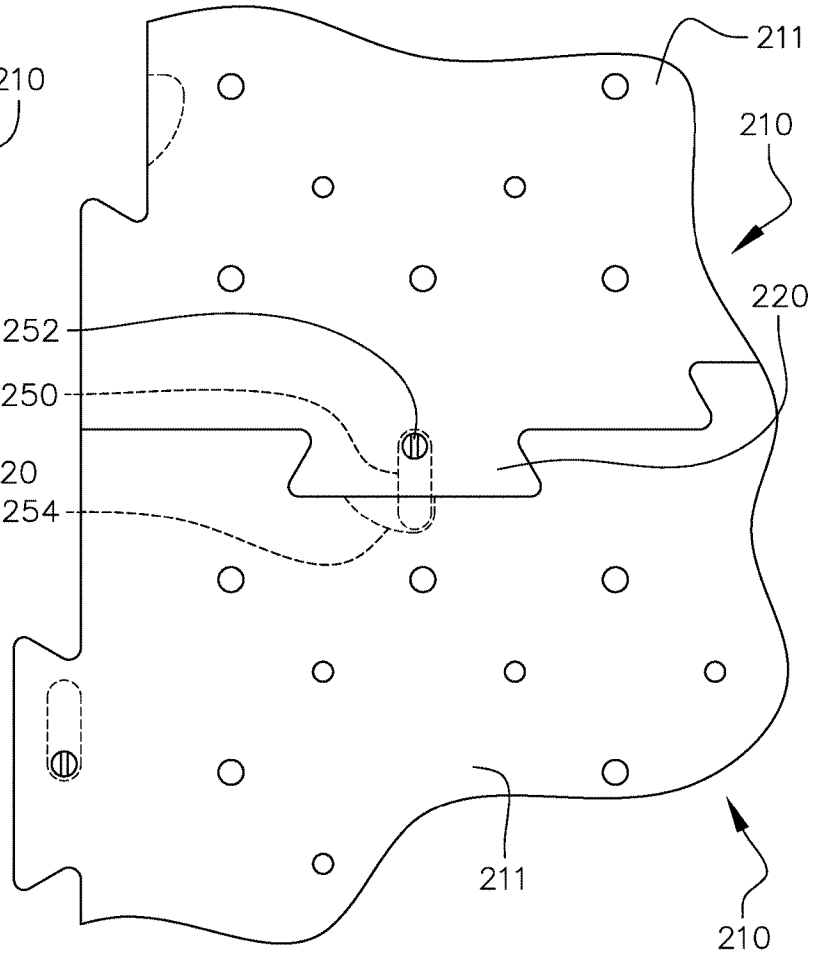
FIG. 18 illustrates a top view with optional locked fastener (twist lock example).
Figure 17:
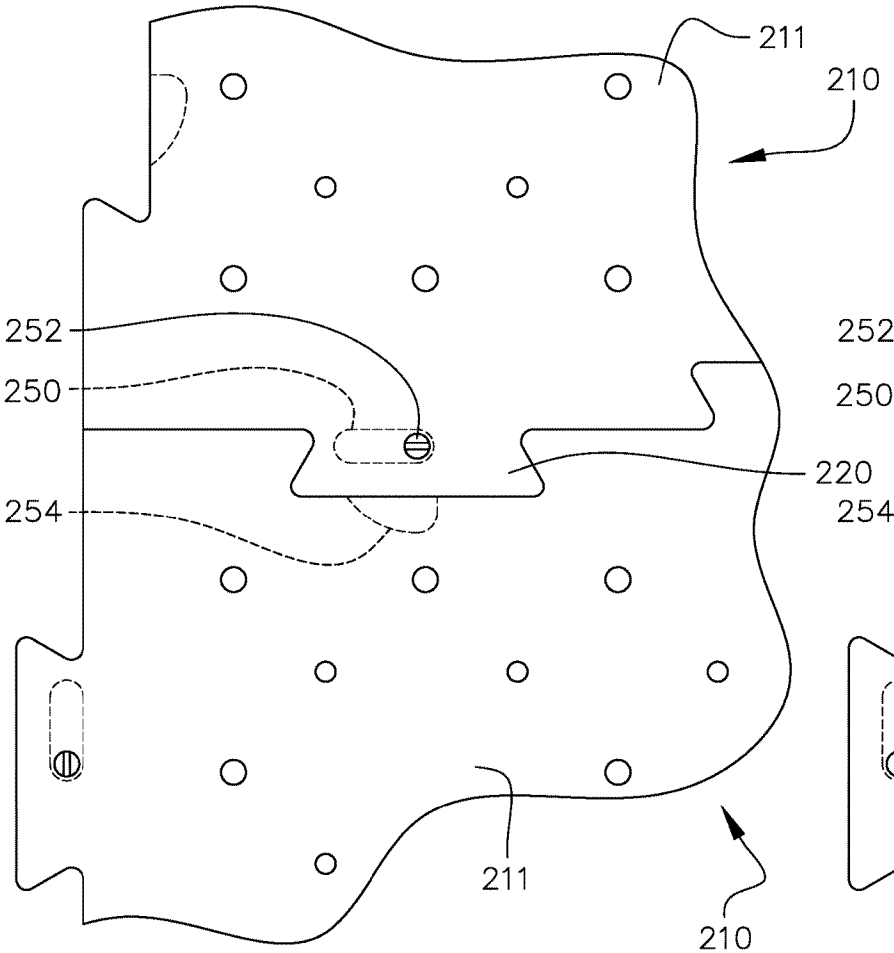
FIG. 17 illustrates a top view with optional unlocked fastener (twist lock example).

Referring to FIGS. 17 and 18, a top view of two adjacent interlocking panels 210 is shown with a panel locking mechanism 250/252/254. In FIG. 17, the panel locking mechanism 250/252/254 is disengaged. In FIG. 18, the panel locking mechanism 250/252/254 is engaged. The panel locking mechanism 250/252/254 includes a locking arm 250 that is engaged/disengaged by turning the actuation head 252 (e.g. a head that receives a screwdriver, hex driver, square driver, etc.). When engaging, the locking arm 250 (e.g. in the keyed projections 220) moves into a slot 254 (e.g. in the keyed projection receivers 212) of an adjacent interlocking panel 210. Note that in some embodiments, the panel locking mechanism 250/252/254 is located in the keyed projection receivers 212 and the slot 254 is located in the keyed projections 220. It is also anticipated that the locking mechanism 250/252/254 be on any side surface of the interlocking panel 210 that contacts with an adjacent interlocking panel 210.

Figure 19:
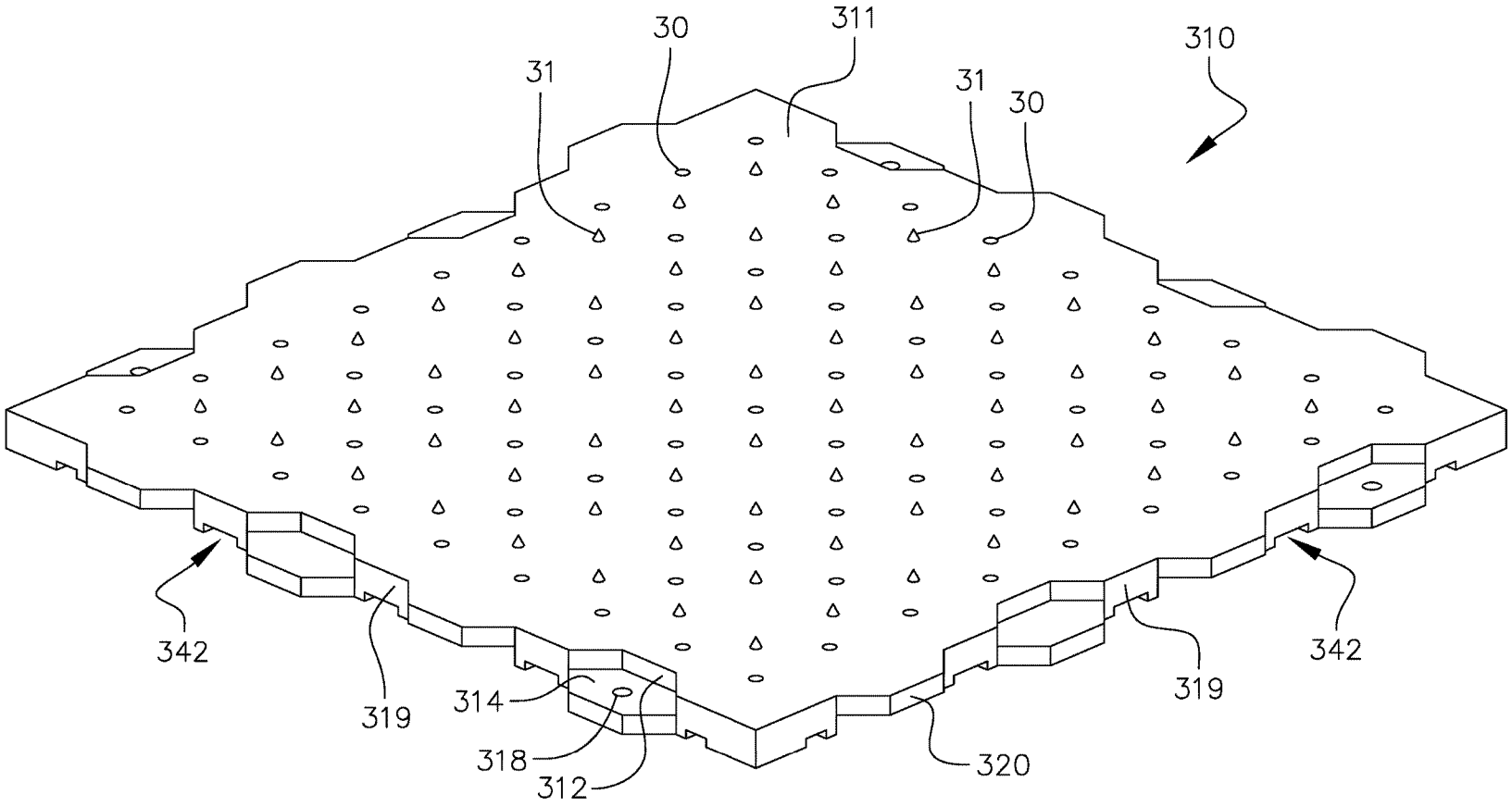
FIG. 19 illustrates a top isometric of a top planar surface and the bottom support structure of an encapsulated panel.
Figure 20:
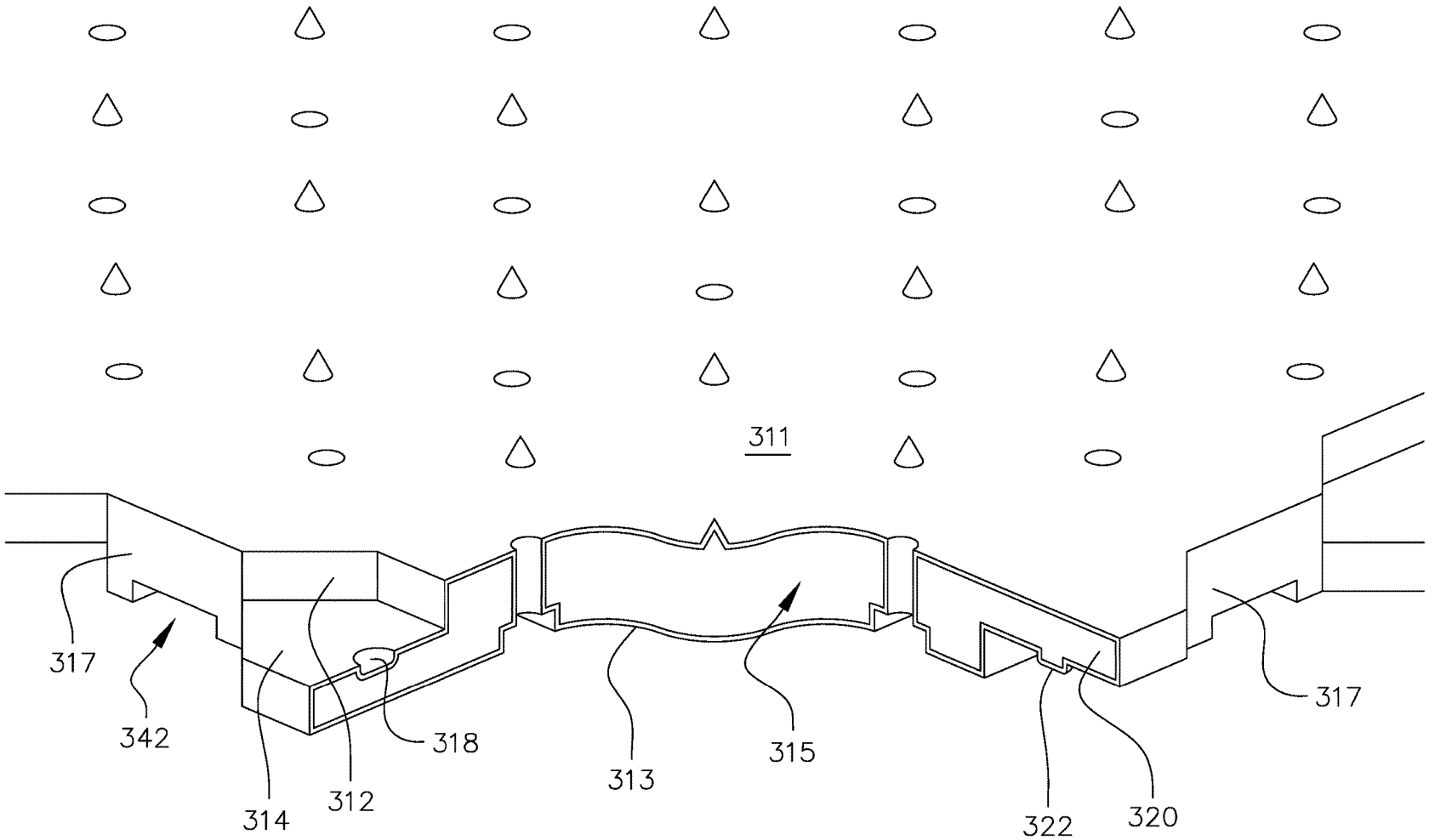
FIG. 20 illustrates a top isometric of a top planar surface and the bottom support structure of an encapsulated panel, shown close up with cut away to show shock absorption inside.

Referring to FIGS. 19 and 20, an interlocking panel 310 is shown. In FIG. 19, a top isometric of an interlocking panel 310 is shown. In FIG. 20, an interlocking panel 310 is shown close up with cut away to show absorption material 315 within. In this embodiment, the shock absorption material 315 is encapsulated by a plastic outer shell 311/313/317 having a substantially planar top surface 311, a bottom surface 313, and side surfaces 317. Although shown with a specific inter-panel locking system that has upwardly facing steps 314/312 having depressions 318 (e.g. concave dimples) and downwardly facing steps 320 having projections 322, any of the prior described inter-panel locking systems are equally anticipated. It is also anticipated that in some embodiments, the depressions 318 are larger in cross-sectional size (e.g. diameter) than the projections 322, allowing for lateral movement of panels as the panels expand/contract due to environmental conditions such as heating/cooling.

In some embodiments, drainage holes 30 are drilled/formed, passing through the plastic outer shell 311/313 and through the shock absorption material 315 such that liquids are free to pass from the planar upper surface 311, through the drainage holes 30 to the bottom surface of the interlocking panel 310. In some embodiments, troughs 342 are formed in the bottom surface 313 permitting flow of such fluids. It is preferred that such troughs 342 from one interlocking panel 310 fluidly interfaces with a trough 342 from an adjacent interlocking panel 310, enabling flow of such fluids between interlocking panels 310.

In some embodiments, the planar top surface 311 includes projections 31 (as discussed previously) such as pointy projections as shown for reducing sideways movement of a covering material 60 such as artificial turf, carpet, etc.

Figure 21:
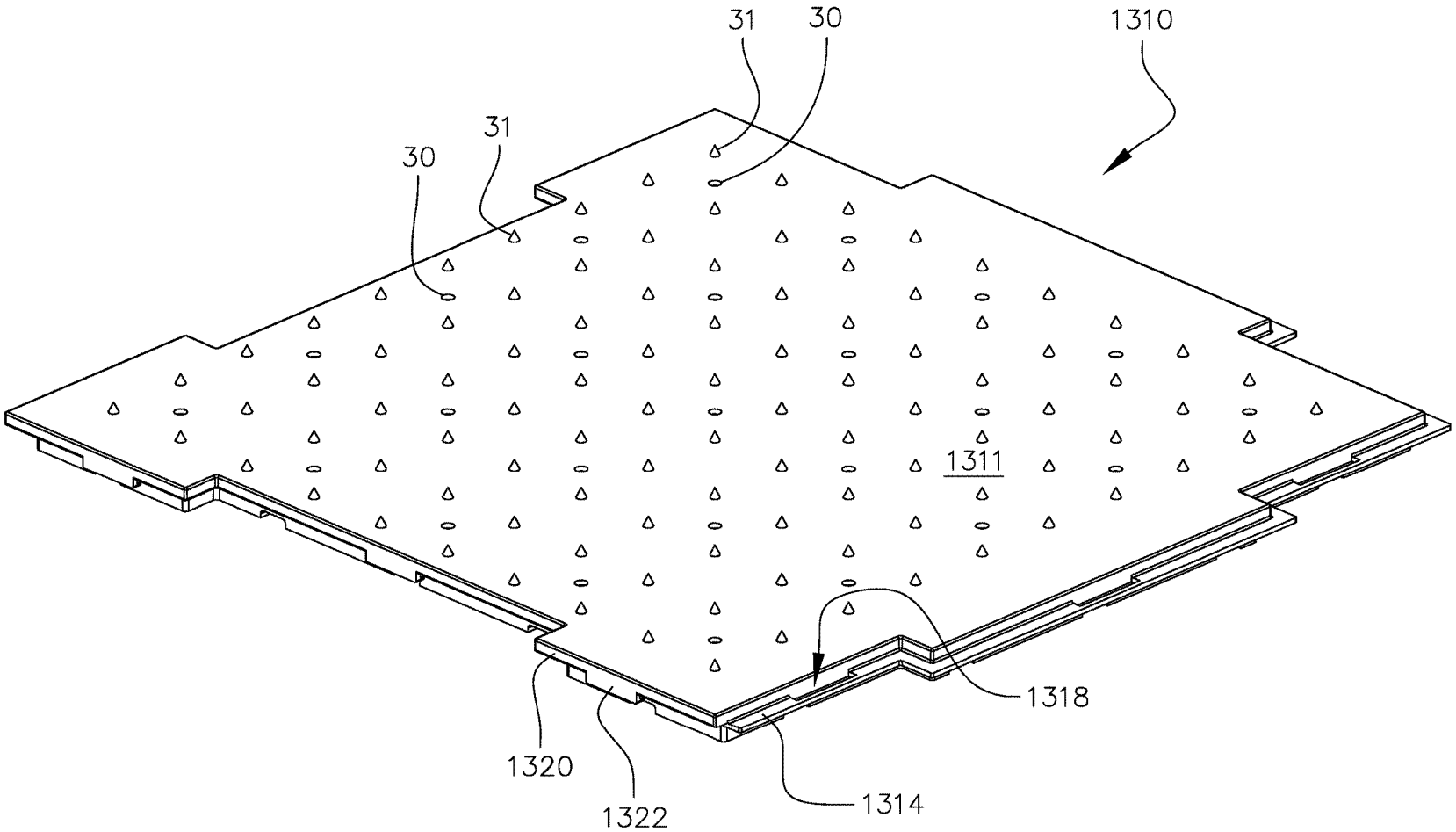
FIG. 21 illustrates a top isometric assembled top planar surface and the bottom support structure of a panel (set-in design).
Figure 22:
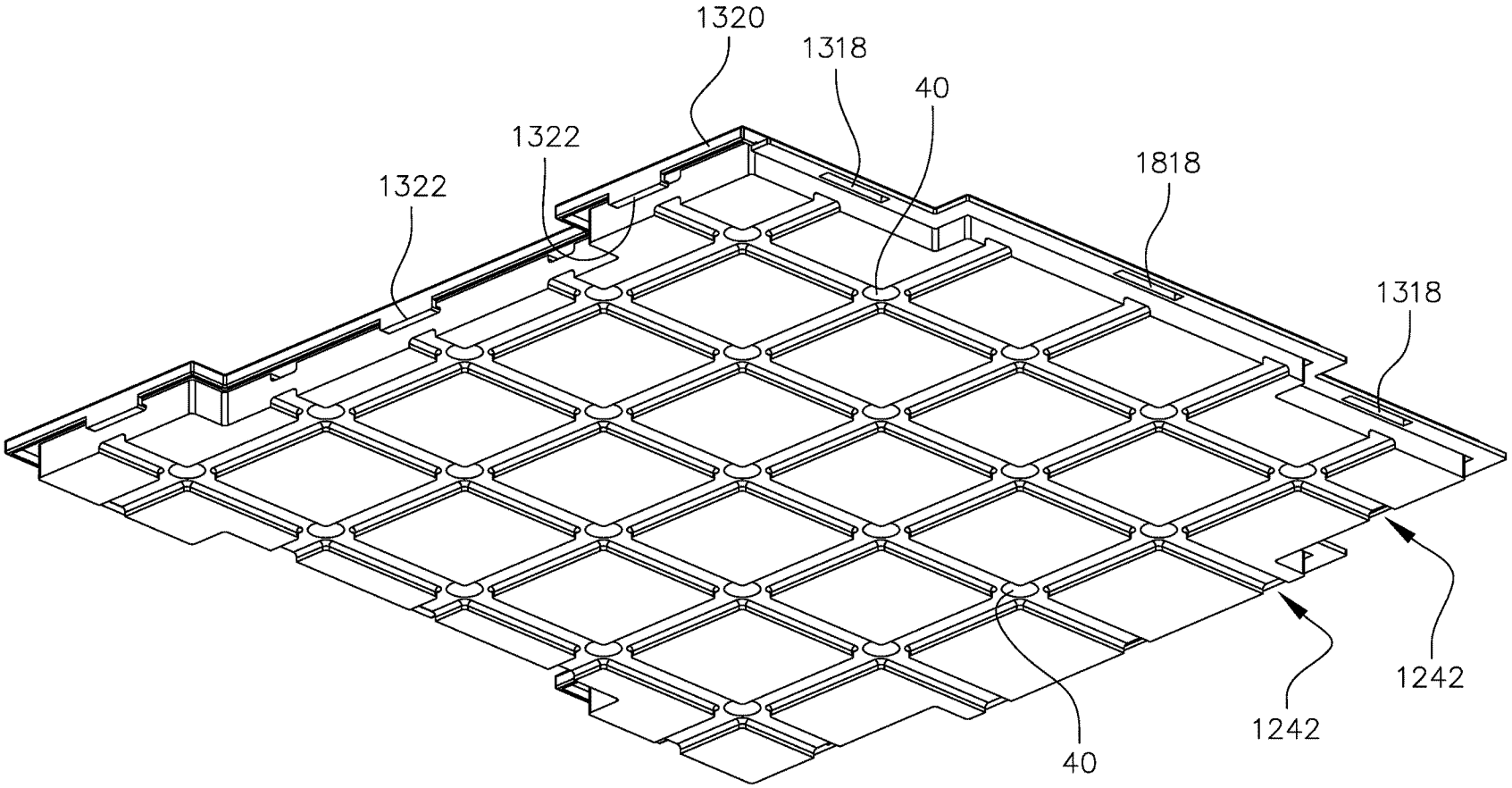
FIG. 22 illustrates a bottom isometric assembled top planar surface and the bottom support structure (set-in design).

Referring to FIGS. 21 and 22, interlocking panels 1310 are shown. Each interlocking panel 1310 includes a top portion 1209 (see FIGS. 23 and 24), having a top surface 1311 that is preferably planar, though may include features such as texture, patterns, etc. The planar top surface 1311 is rigid to semi-rigid (e.g. bends slightly under force). The top portion 1209 has set-in interlock mechanisms 1314/1318/1320/1322. In some embodiments, the top portion 1209 is made from a material that provides the rigid or semi-rigid substantially planar top surface 1311, for example, polypropylene, structural urethane foams, polyolefin, filled plastic, phenolic, stiff rubber, and aluminum, metal, and alloys. In some embodiments, the top portion 1209 is molded from a moldable material (e.g. plastic), or stamped from a stiff material (e.g. aluminum). In some embodiments, the top portion 1209 is a polymer sprayed onto the bottom portion 1207, for example, ⅛" thick sprayed polypropylene or polyurethane.

Supporting the planar top surface 1311 is a bottom support structure 1207 bonded/held thereto. The bottom support structure 1207 is made of a shock absorption material that provides support and resiliency to the top surface 1311. Although any resilient shock absorption material is anticipated, in some embodiments, the shock absorption material is polypropylene foam, expanded polypropylene foam, polyethylene foam, polystyrene foam, urethane foam and/or rubber such as processed recycled rubber. In one example, foam from used mattresses is used.

In some embodiments, the planar top surface 1311 includes projections 31 such as pointy projections as shown for reducing sideways movement of a covering material 60 (see FIGS. 6, 7, 26, 27, 26A, 27A) such as artificial turf, carpet, etc.

In some embodiments, one or more drainage holes 30 are provided in the top surface 1311 for drainage. Liquids (e.g. rain, water, etc.) that fall on the surface 1311, drain through the drainage holes 30. Some of this liquid percolates down into the sub-surface, while in some embodiments, troughs 1242 are formed in the bottom support structure 1207. In such, it is preferred that the drainage holes 30 are fluidly interfaced to the troughs 1242. As it will be shown, the troughs 1242 of one interlocking panel 1310 are preferably fluidly interfaced with troughs 1242 of adjacent interlocking panels 1310, permitting the flow of the fluids between interlocking panels 1310.

Although many panel interlock mechanisms are anticipated, the interlock mechanism of FIGS. 21 and 22 include downward facing protrusions 1322 and receivers 1318. The downward facing protrusions 1322 are formed from a side 1320 of the top portion 1209. Likewise, the receivers 1318 are formed in a ledge 1314 extending from a side of the top portion 1209. As shown, the sides of the top portion 1209 are stepped (e.g. non-linear), though, as will be shown in FIGS. 28-34A, in an alternate embodiment, the sides of the top portion 1209 are substantially linear. Although multiple downward facing protrusions 1322 are shown on one side, there is no limitation as to the number of downward facing protrusions 1322, including a single downward facing protrusion 1322. Likewise, although multiple receivers 1318 are shown on each side of the top portion 1209, there is no limitation as to the number of receivers 1318, including a single receiver 1318. Although it is preferred to have complimentary numbers of downward facing protrusions 1322 and receivers 1318, there is no requirement that the number of downward facing protrusions 1322 match the number of receivers 1318, though it is also preferred that the there be a greater number of receivers 1318 than there are downwardly facing protrusions 1322. Additionally, although described as downwardly facing protrusions 1322, it is equally anticipated that the protrusions face upwardly and instead of the downwardly facing protrusions 1322 being set within the receivers 1318, the receivers 1318 are set atop the upwardly facing protrusion. Also, although the cross-sectional shape of the downwardly facing protrusion 1322 is shown as rectangular and the opening of the receiver 1318 is also shown as rectangular, there is no limitation to these shapes.

The bottom support structure 1207 includes holes 40 that are aligned with the drainage holes 30 for through-flow of liquids from the surface 1311 to an area below the interlocking panel 1310 and/or the optional troughs 1242.

Figure 23:
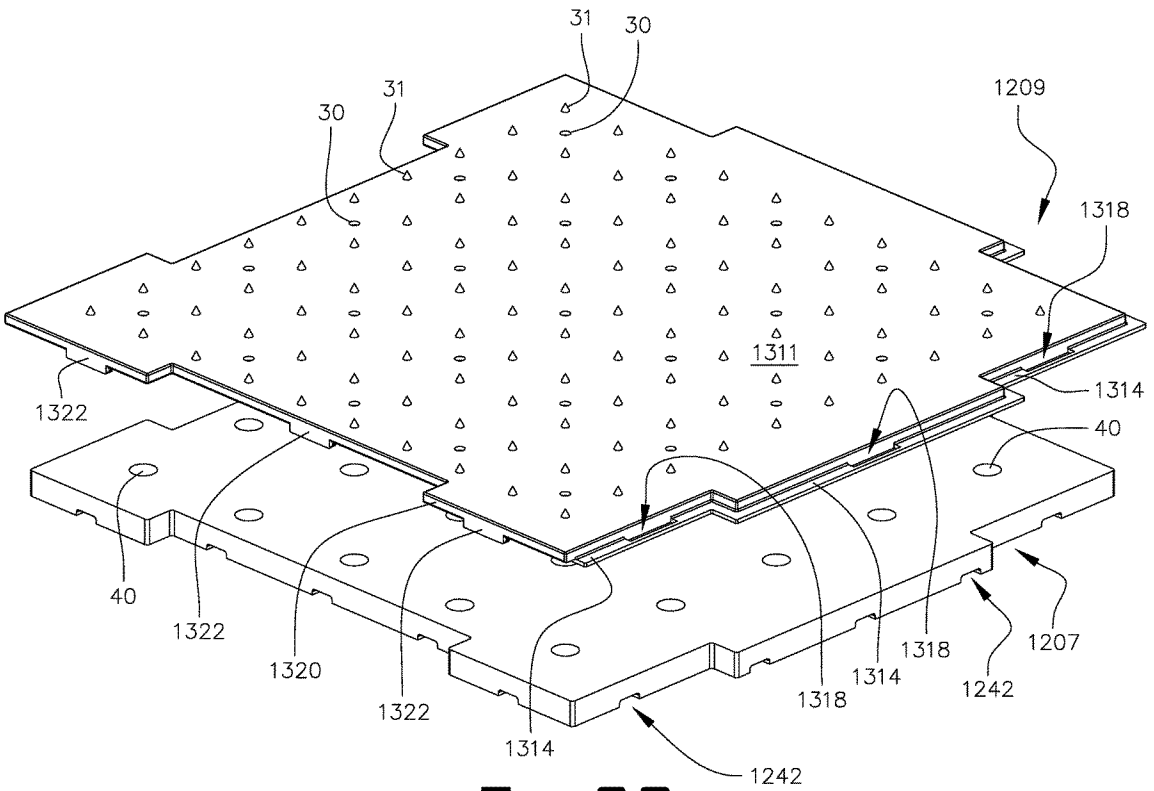
FIG. 23 illustrates a top isometric exploded top planar surface and the bottom support structure (set-in design).
Figure 24:
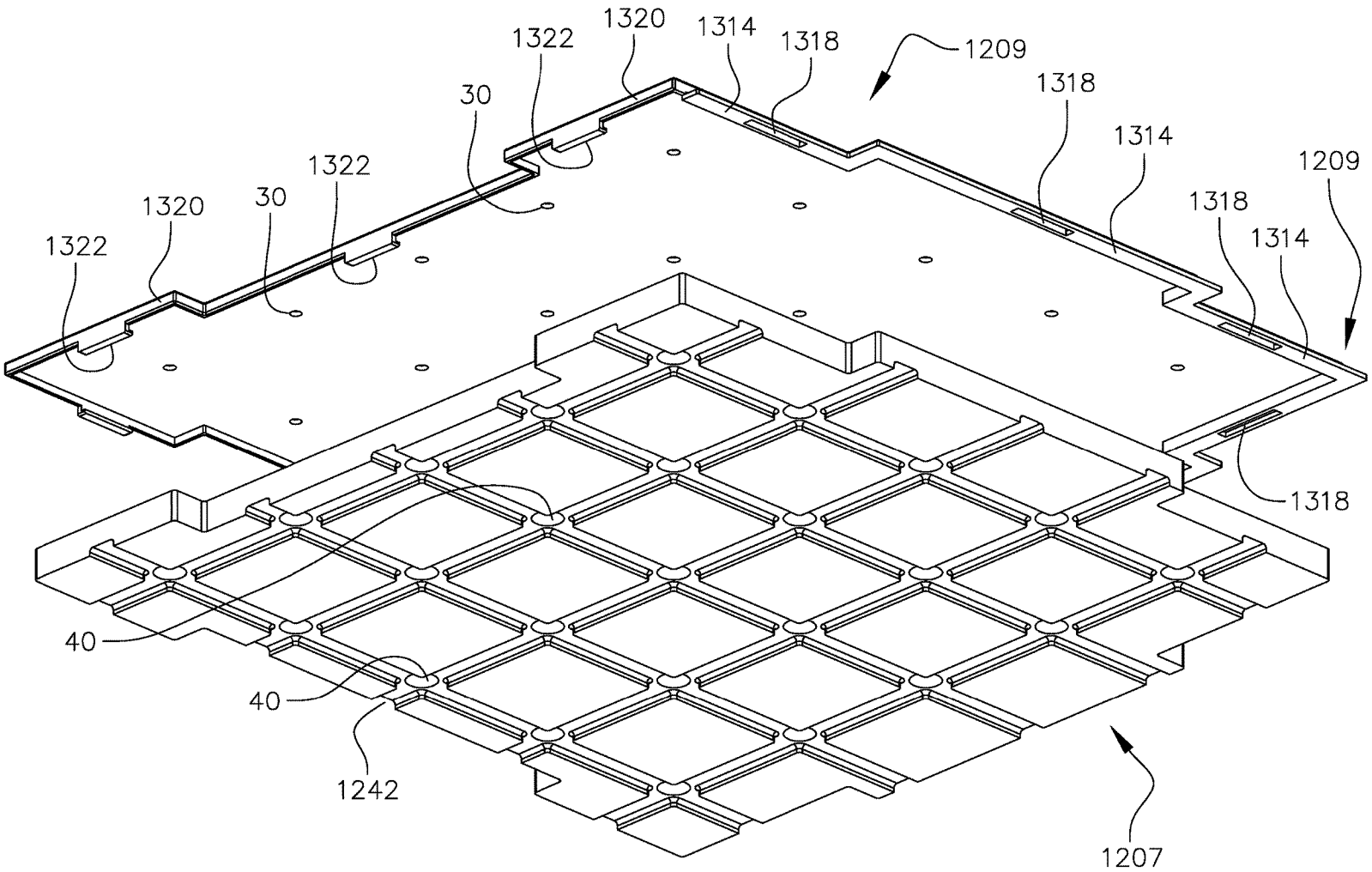
FIG. 24 illustrates a bottom isometric exploded top planar surface and the bottom support structure (set-in design).

Referring to FIGS. 23 and 24, top and bottom isometric exploded views of the top portion 1209 and the bottom support structure 1207 are shown. In these views, the top portion 1209 is separated from the bottom support structure 1207. The bottom support structure 1207 includes holes 40 that are aligned with the drainage holes 30 of the top planar surface 1311, so as to provide drainage through both the top portion 1209 and the bottom support structure 1207.

In some embodiments, the top portion 1209 is held to the bottom support structure 1207 by an adhesive between the top portion 1209 and the bottom support structure 1207. In some embodiments, the top portion 1209 is held to the bottom support structure 1207 by molding the bottom support structure 1207 directly within the top portion 1209. In some embodiments, the bottom support structure 1207 is held to an undersurface of the top portion 1209 by features on the undersurface of the top portion 1209 such as barbs.

Figure 25:
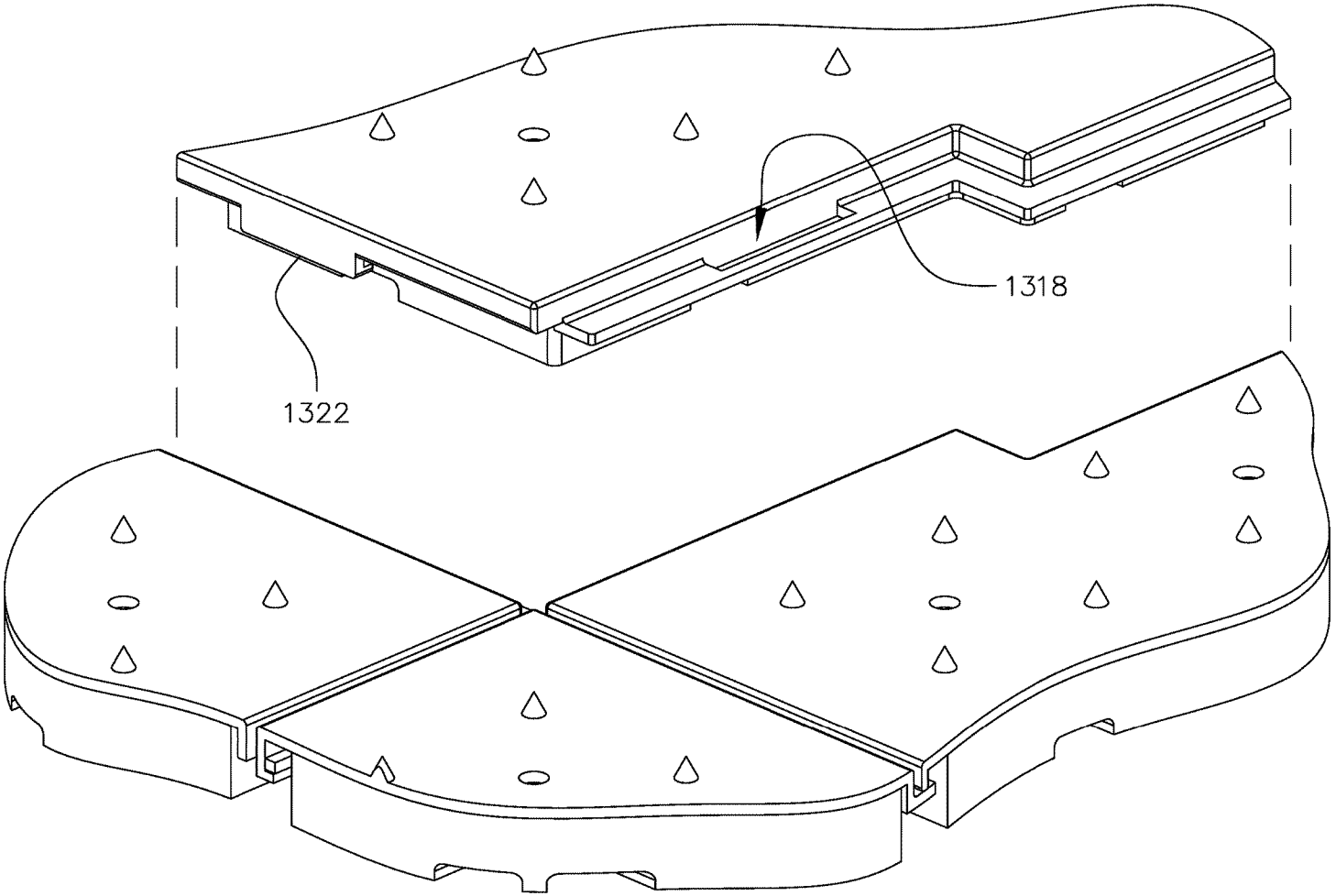
FIG. 25 illustrates a top isometric of a multiple panel assembly (set-in design).

Referring to FIG. 25, a top isometric view of multiple interlocking panel 1310 assemblies is shown. To cover larger areas, multiple interlocking panels 1310 are joined along their edges, downward facing protrusions 1322 and receivers 1318 mating and interlocking by way of the downward facing protrusions 1322 resting within the receivers 1318, holding the adjacent interlocking panels 1310 together.

Figure 26:
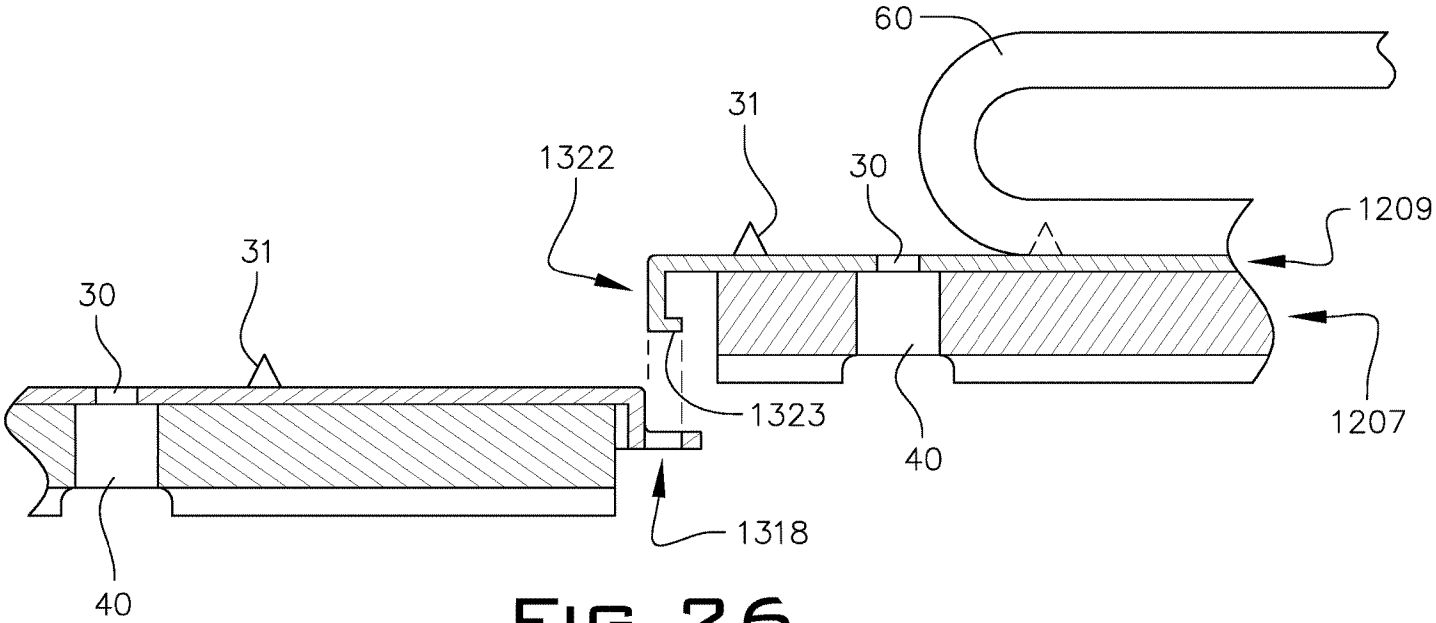
FIG. 26 illustrates a cross section of two panels prior to assembly with cover material rolled back (set-in design with lip).
Figure 27:
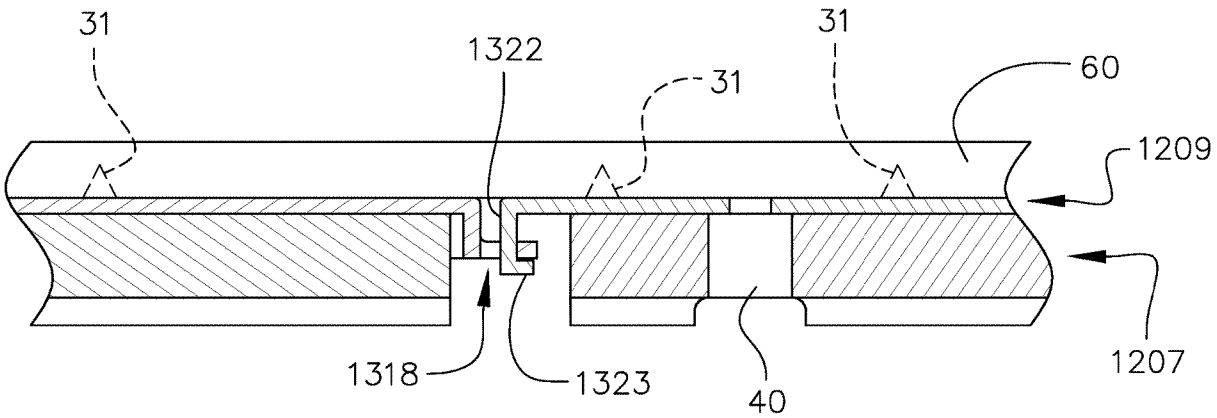
FIG. 27 illustrates a cross section of two panels assembled with cover material (set-in design with lip).
Figure 26A:
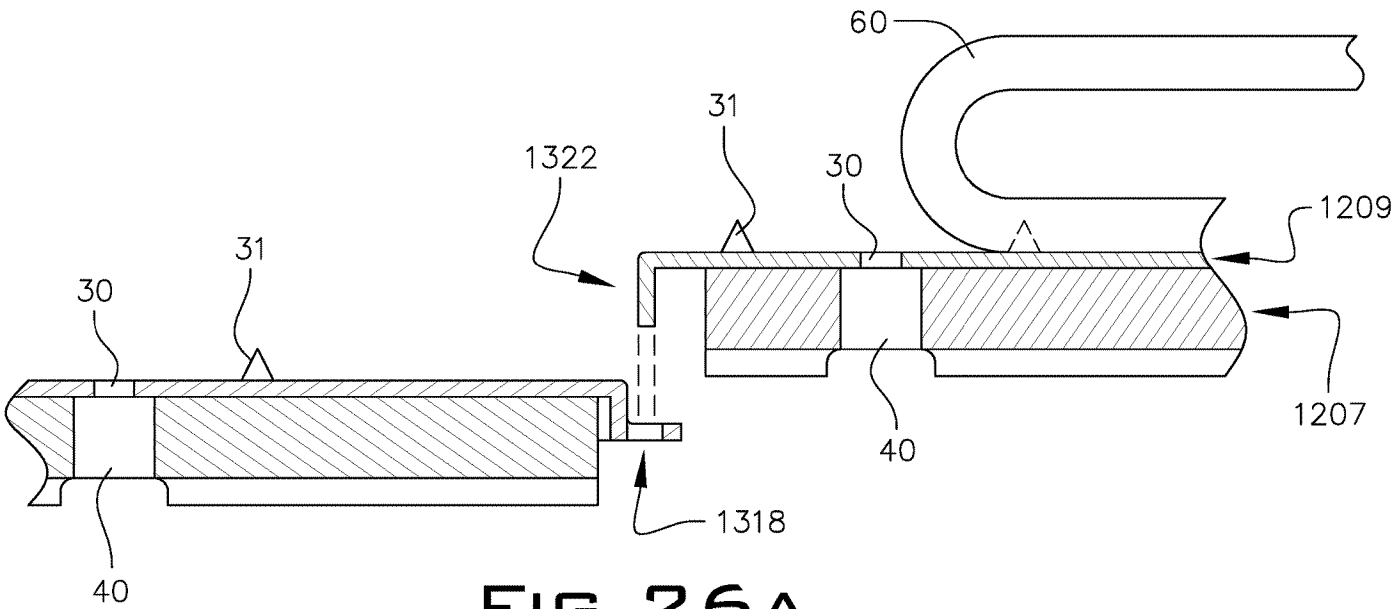
FIG. 26A illustrates a cross section of two panels prior to assembly with cover material rolled back (set-in design without lip).
Figure 27A:
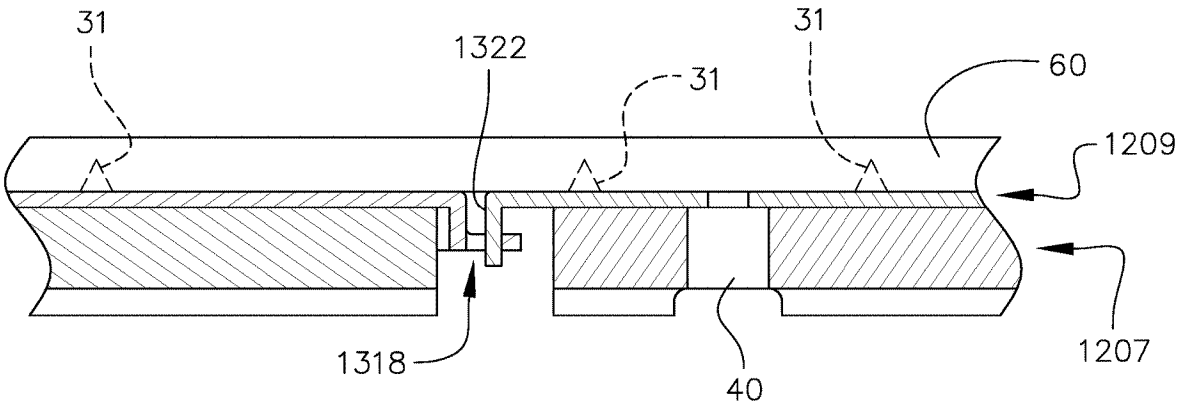
FIG. 27A illustrates a cross section of two panels assembled with cover material (set-in design without lip).

There are two types of downward facing protrusions 1322 anticipated as will be shown in FIGS. 26, 26A, 27, 27A. In FIGS. 26 and 27, the downward facing protrusions 1322 have lips 1323 that, after insertion into the receivers 1318, the lips 1323 lock beneath an edge of the receivers 1318. In FIGS. 26A and 27A, the downward facing protrusions 1322 do not have lips and after insertion into downward facing protrusions 1322 are able to lift out of the receivers 1318, held by gravity and the cover material 60.

Referring to FIGS. 26, 26A, 27, and 27A, cross section views of two interlocking panels 1310 are shown prior to assembly with the cover material 60 rolled back in FIGS. 26 and 26A; and assembled with cover material 60 in place in FIGS. 27 and 27A.

In FIG. 26, the downward facing protrusion 1322 is moving into the receiver 1318. After the downward facing protrusion 1322 moves into the receiver 1318, the lip 1323 hooks under an edge of the receiver 1318 as shown in FIG. 27; thereby reducing upward shifting of adjacent interlocking panels 1310.

In FIG. 26A, the downward facing protrusion 1322 without a lip 1323 is moving into the receiver 1318. In FIG. 27A, the downward facing protrusion 1322 is in the receiver 1318, thereby maintaining the location of adjacent interlocking panels 1310.

The cover material 60 is any covering material such as carpet, linoleum, vinyl, wood, synthetic wood, ceramic tile, plastic tile, artificial turf, synthetic grass, etc. In embodiments in which the top surface 1311 includes projections 31 (e.g. barbs), the projections 31 increase friction between the bottom surface of the cover material 60 and the top surface 1311, thereby reducing lateral slippage of the cover material 60 as lateral forces are applied to the cover material 60.

Figure 28:
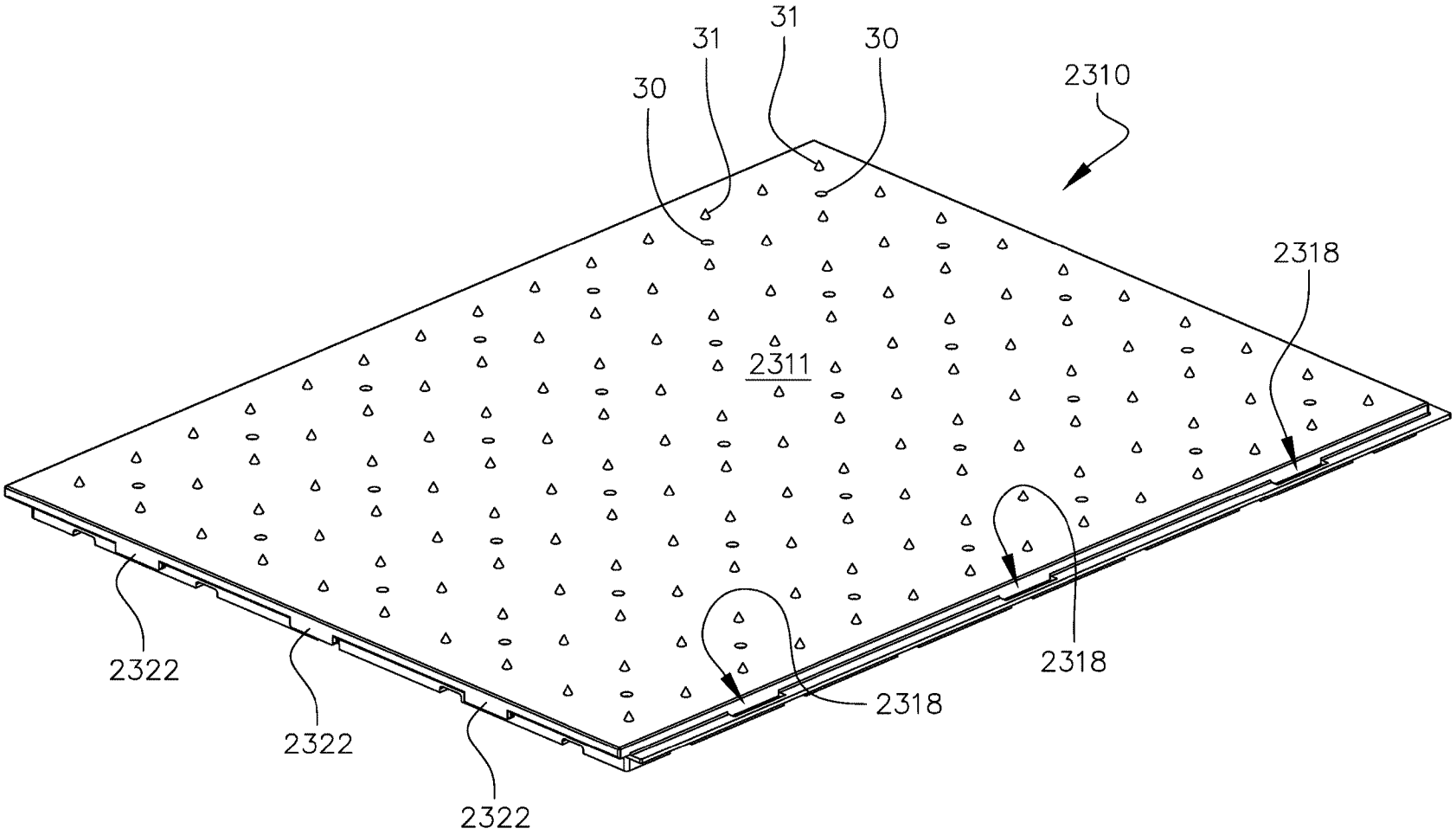
FIG. 28 illustrates a top isometric assembled top planar surface and the bottom support structure of a panel (set-in design, linear edge).
Figure 29:
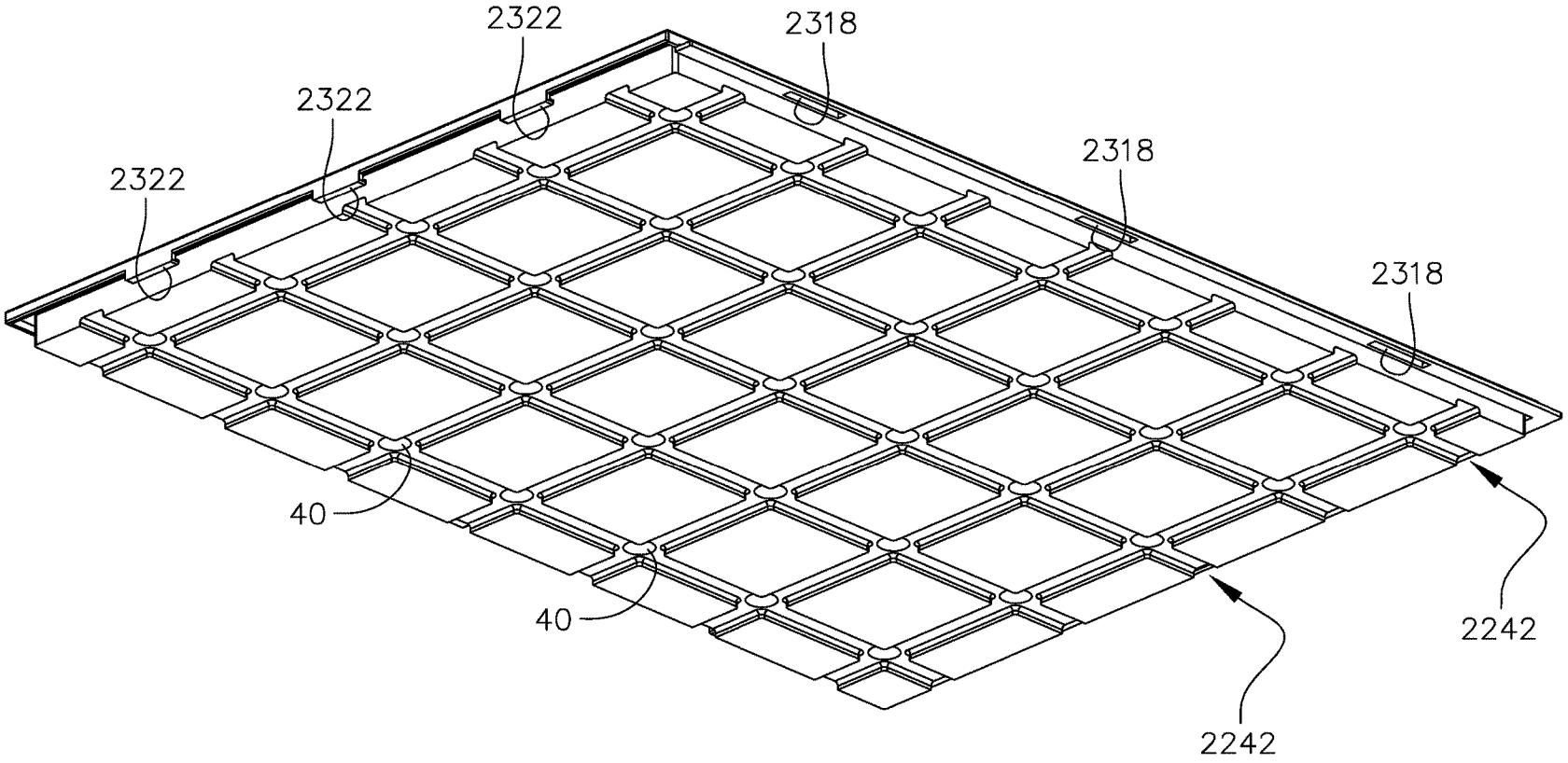
FIG. 29 illustrates a bottom isometric assembled top planar surface and the bottom support structure (set-in design, linear edge).

Referring to FIGS. 28 and 29, interlocking panels 2310 are shown. Each interlocking panel 2310 includes a top portion 2209 (see FIGS. 30 and 31), having a top surface 2311 that is preferably planar, though surface features and texture is fully anticipated. The planar top surface 2311 is rigid to semi-rigid (e.g. bends slightly under force). The top portion 2209 has set-in interlock mechanisms 2314/2318/2320/2322. In some embodiments, the top portion 2209 is made, formed, or molded from a material that provides the rigid or semi-rigid substantially planar top surface 2311, for example, polypropylene, structural urethane foams, polyolefin, filled plastic, phenolic, stiff rubber, and aluminum. In some embodiments, the top portion 2209 is a polymer sprayed onto the bottom portion 2207, for example, ⅛" thick sprayed polypropylene or polyurethane.

Supporting the top surface 2311 is a bottom support structure 2207 bonded/held thereto. The bottom support structure 2207 is made of a shock absorption material that provides support and resiliency to the top surface 2311. Although any resilient shock absorption material is anticipated, in some embodiments, the shock absorption material is polypropylene foam, expanded polypropylene foam, polyethylene foam, polystyrene foam, urethane foam and/or rubber such as processed recycled rubber. In one example, recycled foam is used.

In some embodiments, the planar top surface 2311 includes projections 31 such as pointy projections as shown for reducing sideways movement of a covering material 60 (see FIGS. 6, 7, 26, 27, 26A, 27A, 33, 34, 33A, 34A) such as artificial turf, carpet, etc.

In some embodiments, one or more drainage holes 30 are provided in the top surface 2311 for drainage. Liquids (e.g. rain, water, etc.) that fall on the surface 2311, drain through the drainage holes 30. Some of this liquid percolates down into the sub-surface, while in some embodiments, troughs 2242 are formed in the bottom support structure 2207. In such, it is preferred that the drainage holes 30 are fluidly interfaced to the troughs 2242. As it will be shown, the troughs 2242 of one interlocking panel 2310 are preferably fluidly interfaced with troughs 2242 of adjacent interlocking panels 2310, permitting the flow of the fluids between interlocking panels 2310.

Figure 30:
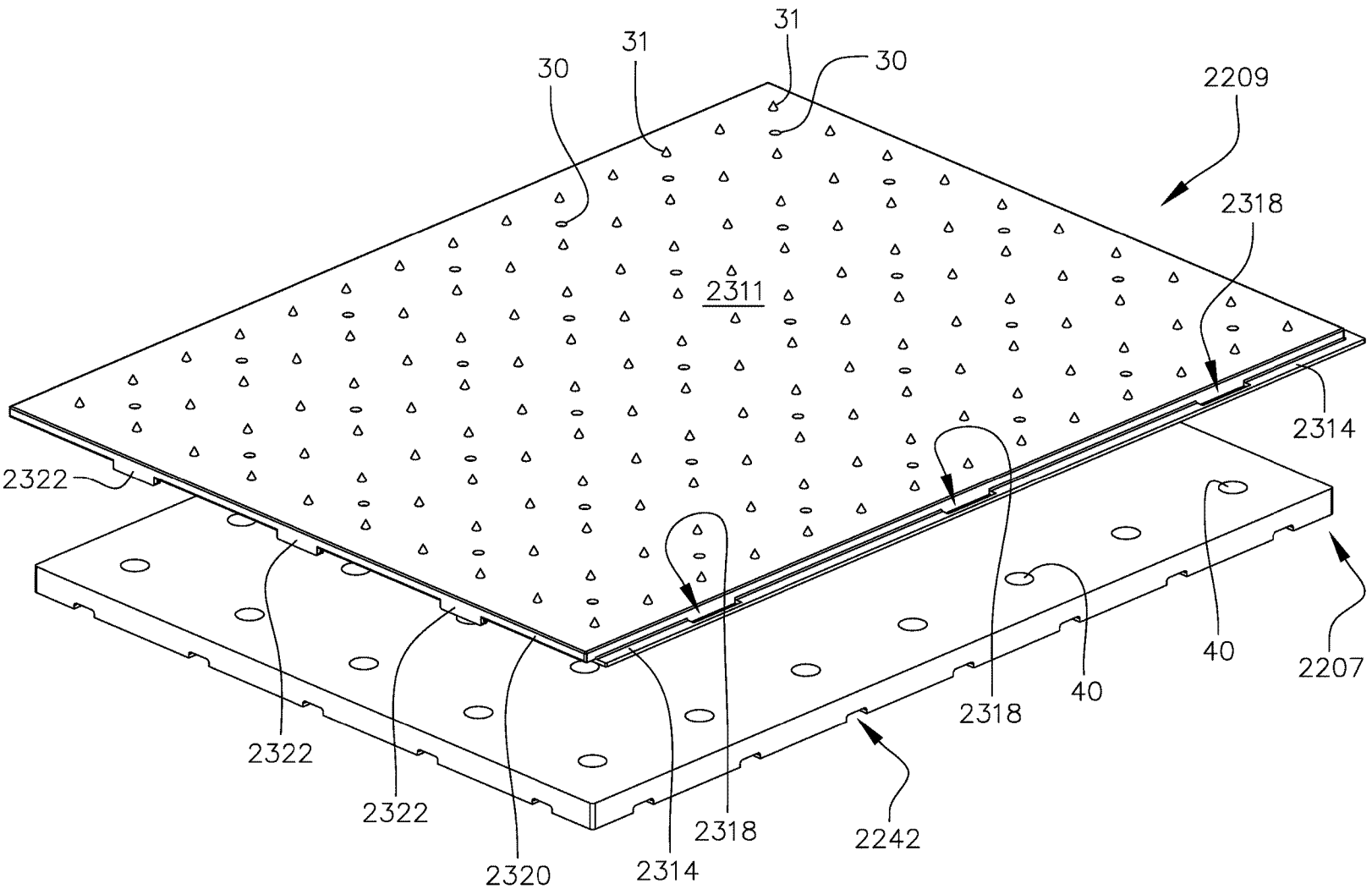
FIG. 30 illustrates a top isometric exploded top planar surface and the bottom support structure (set-in design, linear edge).
Figure 31:
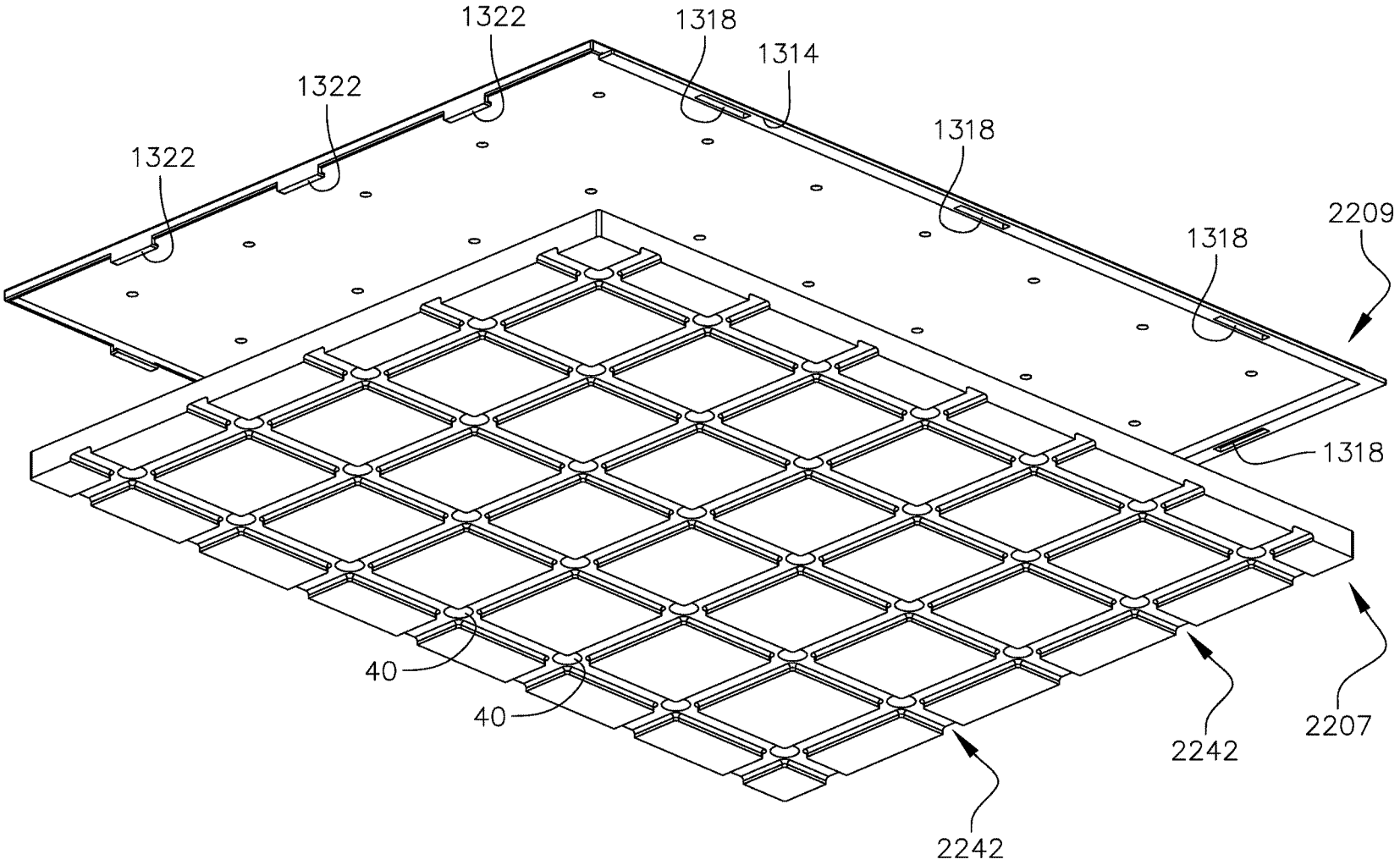
FIG. 31 illustrates a bottom isometric exploded top planar surface and the bottom support structure (set-in design, linear edge).

Although many panel interlock mechanisms are anticipated, the interlock mechanism of FIGS. 30 and 31 include downward facing protrusions 2322 and receivers 2318. The downward facing protrusions 2322 are formed from a side 2320 (see FIGS. 30/31) of the top portion 2209. Likewise, the receivers 2318 are formed in a ledge 2314 extending from a side of the top portion 2209. As shown, the sides of the top portion 2209 are linear, in contrast to those shown shown in FIGS. 21-27A, in an alternate embodiment, the sides of the top portion 2209 are substantially linear.

Although multiple downward facing protrusions 2322 are shown on one side, there is no limitation as to the number of downward facing protrusions 2322, including a single downward facing protrusion 2322 per side. Likewise, although multiple receivers 2318 are shown on each side of the top portion 2209, there is no limitation as to the number of receivers 2318, including a single receiver 2318. Although it is preferred to have complimentary numbers of downward facing protrusions 2322 and receivers 2318, there is no requirement that the number of downward facing protrusions 2322 match the number of receivers 2318, though it is also preferred that the be a greater number of receivers 2318 than there are downwardly facing protrusions 2322. Additionally, although described as downwardly facing protrusions 2322, it is equally anticipated that the protrusions face upwardly and instead of the downwardly facing protrusions 2322 being set within the receivers 2318, the receivers 2318 are set atop the upwardly facing protrusion. Also, although the cross-sectional shape of the downwardly facing protrusion 2322 is shown as rectangular and the opening of the receiver 2318 is also shown as rectangular, there is no limitation to these shapes.

The bottom support structure 2207 includes holes 40 that are aligned with the drainage holes 30 for through-flow of liquids from the surface 2311 to an area below the interlocking panel 2310 and/or the optional troughs 2242.

Referring to FIGS. 30 and 31, top and bottom isometric exploded views of the top portion 2209 and the bottom support structure 2207 are shown. In these views, the top portion 2209 is separated from the bottom support structure 2207. The bottom support structure 2207 includes holes 40 that are aligned with the drainage holes 30 of the top surface 2311, so as to provide drainage through both the top portion 2209 and the bottom support structure 2207.

In some embodiments, the top portion 2209 is held to the bottom support structure 2207 by an adhesive between the top portion 2209 and the bottom support structure 2207. In some embodiments, the top portion 2209 is held to the bottom support structure 2207 by molding the bottom support structure 2207 directly within the top portion 2209. In some embodiments, the bottom support structure 2207 is held to an undersurface of the top portion 2209 by features on the undersurface of the top portion 2209 such as barbs.

Figure 32:
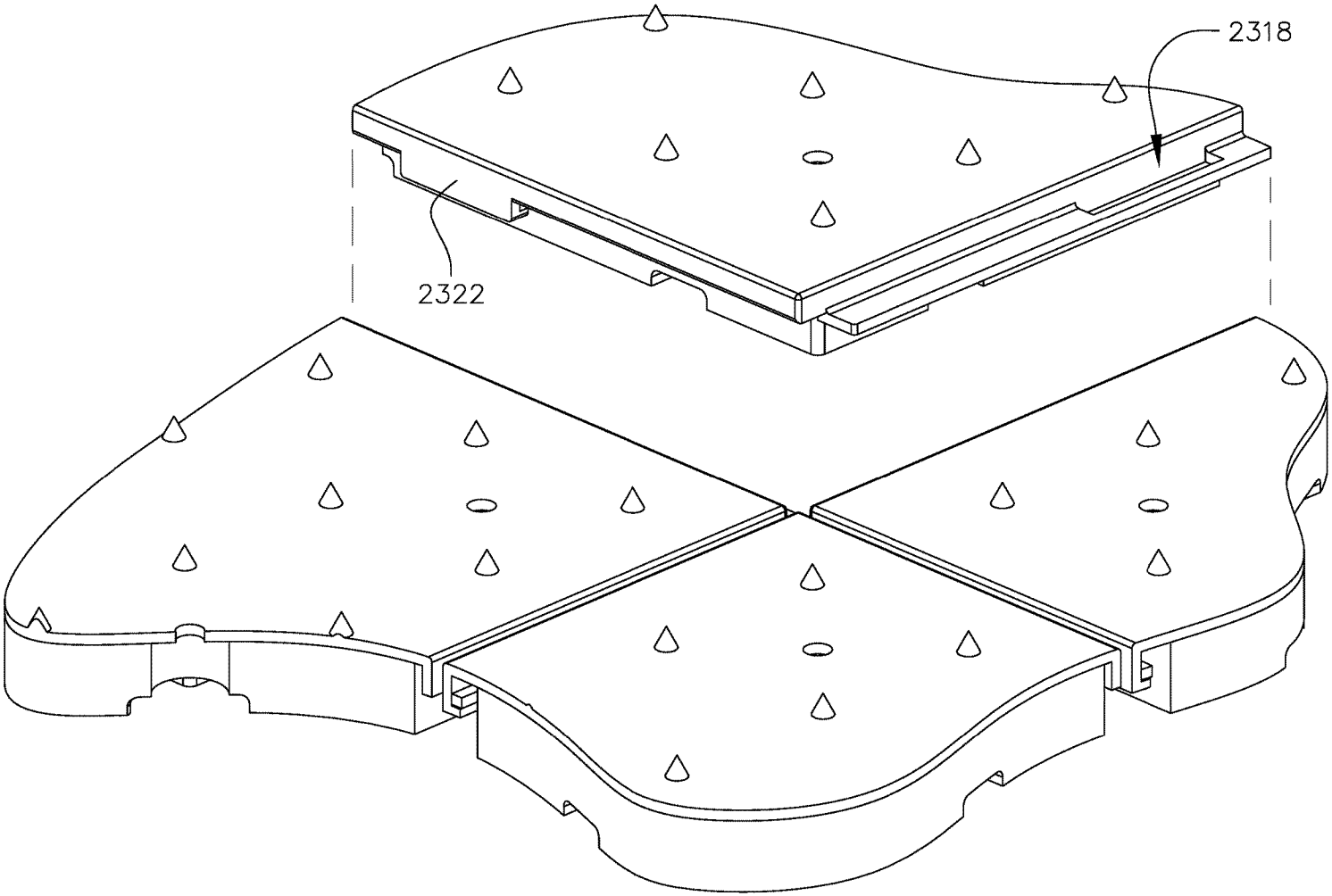
FIG. 32 illustrates a top isometric of a multiple panel assembly (set-in design, linear edge).

Referring to FIG. 32, a top isometric view of multiple interlocking panel 2310 assemblies is shown. To cover larger areas, multiple interlocking panels 2310 are joined along their edges, downward facing protrusions 2322 and receivers 2318 mating and interlocking by way of the downward facing protrusions 2322 resting within the receivers 2318, holding the adjacent interlocking panels 2310 together.

Figure 33:
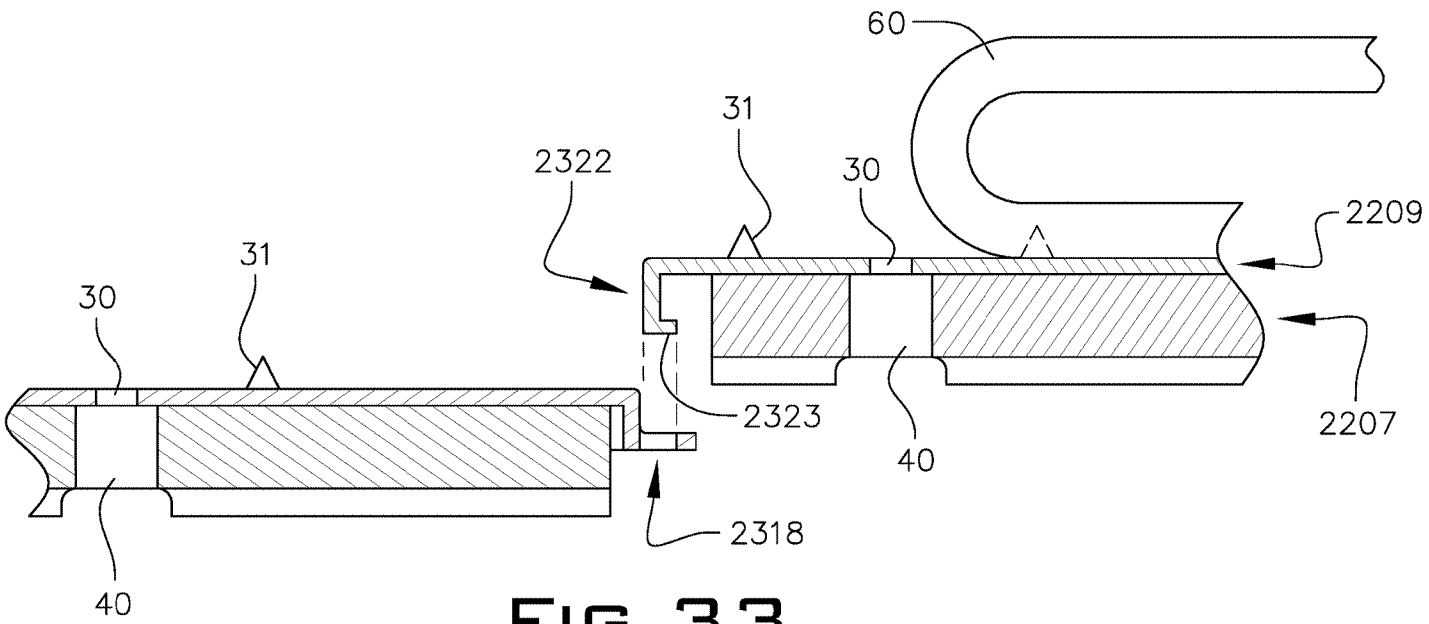
FIG. 33 illustrates a cross section of two panels prior to assembly with cover material rolled back (set-in design, linear edge, with lip).
Figure 34:
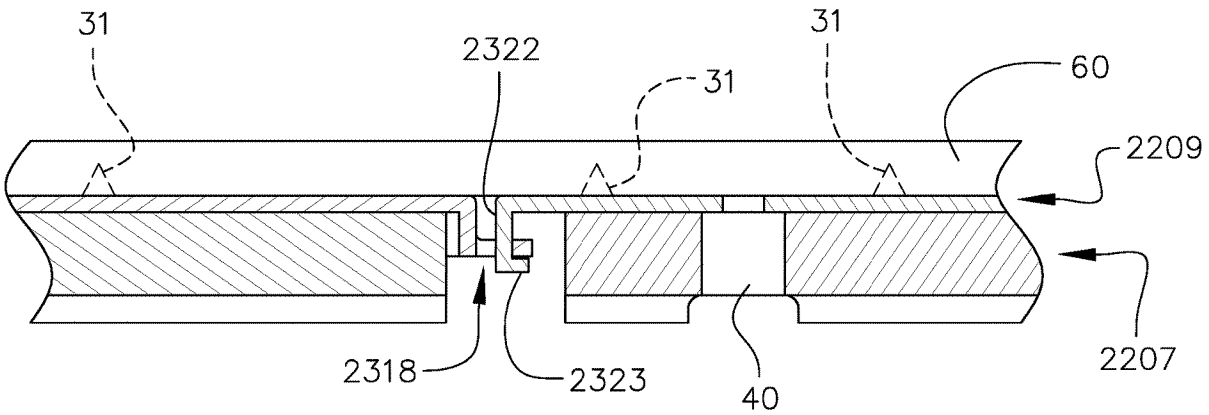
FIG. 34 illustrates a cross section of two panels assembled with cover material (set-in design, linear edge, with lip).
Figure 33A:
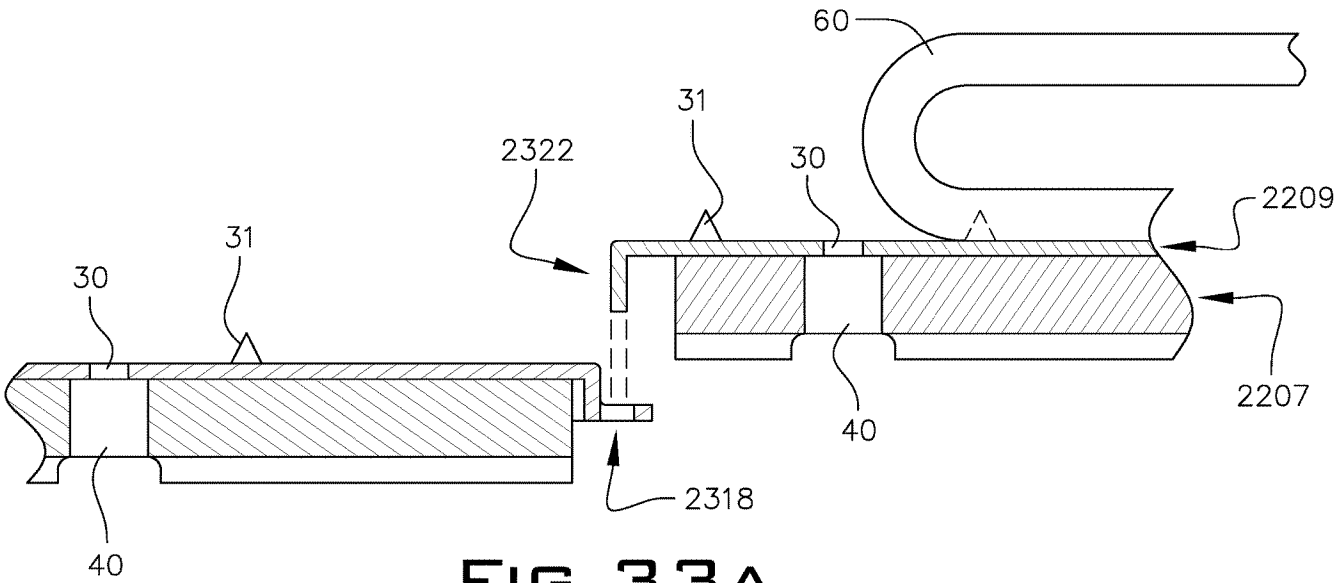
FIG. 33A illustrates a cross section of two panels prior to assembly with cover material rolled back (set-in design, linear edge, without lip).
Figure 34A:
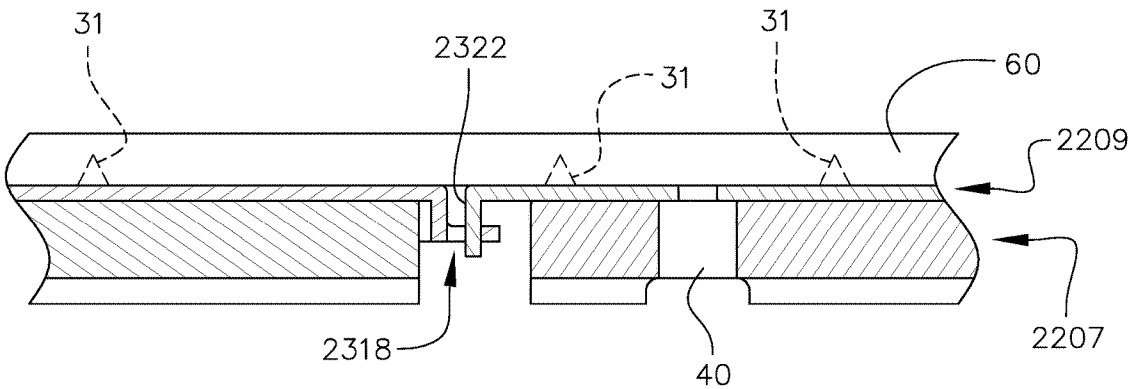
FIG. 34A illustrates a cross section of two panels assembled with cover material (set-in design, linear edge, without lip).

There are two types downward facing protrusions 2322 anticipated as will be shown in FIGS. 33, 33A, 34, 34A. In FIGS. 33 and 34, the downward facing protrusions 2322 have lips 2323 that, after insertion into the receivers 2318, the lips 2323 lock beneath an edge of the receivers 2318. In FIGS. 33A and 34A, the downward facing protrusions 2322 do not have lips and after insertion into downward facing protrusions 2322 are able to lift out of the receivers 2318, held by gravity and the cover material 60.

Referring to FIGS. 33, 33A, 34, and 34A, cross section views of two interlocking panels 2310 are shown prior to assembly with the cover material 60 rolled back in FIGS. 33 and 33A; and assembled with cover material 60 in place in FIGS. 34 and 34A.

In FIG. 33, the downward facing protrusion 2322 is moving into the receiver 2318. After the downward facing protrusion 2322 moves into the receiver 2318, the lip 2323 hooks under an edge of the receiver 2318 as shown in FIG. 34; thereby reducing upward shifting of adjacent interlocking panels 1310.

In FIG. 33A, the downward facing protrusion 2322 without a lip 2323 is moving into the receiver 2318. In FIG. 34A, the downward facing protrusion 2322 is in the receiver 2318, thereby maintaining the location of adjacent interlocking panels 2310.

The cover material 60 is any covering material such as carpet, linoleum, vinyl, wood, synthetic wood, ceramic tile, plastic tile, artificial turf, synthetic grass, etc. In embodiments in which the top surface 2311 includes projections 31 (e.g. barbs), the projections 31 increase friction between the bottom surface of the cover material 60 and the top surface 2311, thereby reducing lateral slippage of the cover material 60 as lateral forces are applied to the cover material 60.

In some embodiments, the downward facing protrusions 1322/2322 are sized to fit within the receivers 1318/2318 in a way as to provide room for thermal expansion and/or thermal contraction.

Equivalent elements can be substituted for the ones set forth above such that they perform in substantially the same manner in substantially the same way for achieving substantially the same result.

It is believed that the system and method of the present invention and many of its attendant advantages will be understood by the foregoing description. It is also believed that it will be apparent that various changes may be made in the form, construction and arrangement of the components thereof without departing from the scope and spirit of the invention or without sacrificing all of its material advantages. The form herein before described being merely exemplary and explanatory embodiment thereof. It is the intention of the following claims to encompass and include such changes. For example, throughout the description, the convex projection is located on the bottom of the downward facing step and the concave dimple is located on the top of the upward facing step, but the present invention works equally as well with the convex projection located on the top of the upward facing step and the concave dimple on the bottom of the downward facing step.

What is claimed is:

1. A floor panel comprising:

a top portion of the floor panel having a substantially planar top surface and side surfaces, the side surfaces depending downward from the substantially planar top surface forming a cavity in an underside of the substantially planar top surface, the underside of the substantially planar top surface is absent of any vertical supports, at least one of the side surfaces having downward facing protrusions and at least one other of the side surfaces having receivers for interlocking of adjacent floor panels;

a bottom support structure, the bottom support structure filling the cavity, thereby providing support and shock absorption to the substantially planar top surface.

2. The floor panel of claim 1, further comprising a bottom surface interfaced to the side surfaces, thereby encapsulating the bottom support structure.

3. The floor panel of claim 1, wherein at least one of the downward facing protrusions has a lip, the lip locking within the receiver of the adjacent floor panel.

4. The floor panel of claim 1, wherein each of the side edges is substantially linear.

5. The floor panel of claim 1, wherein each of the sides is stepped.

6. The floor panel of claim 1, wherein the top portion is molded from a material selected from the group consisting of polypropylene, structural urethane foams, polyolefin, filled plastic, phenolic, stiff rubber, aluminum, metal, and alloys.

7. The floor panel of claim 1, wherein the bottom support structure is made from one or more materials selected from the group consisting polypropylene foam, expanded polypropylene foam, expanded polyethylene foam, polyethylene foam, expanded polystyrene foam, expanded urethane foam and rubber.

8. The floor panel of claim 1, wherein the substantially planar top surface is covered with a material selected from the group consisting of carpet, linoleum, vinyl, wood, synthetic wood, ceramic tile, plastic tile and artificial turf.

9. A floor panel comprising:

a top portion of the floor panel having a substantially planar top surface and side surfaces depending downwardly from edges of the substantially planar top surface forming a cavity beneath the substantially planar top surface, at least one of the side surfaces having protrusions and at least one other of the side surfaces having receivers for interlocking with the protrusions of an adjacent floor panel;

a bottom support structure comprised of a shock absorption material, the bottom support structure held within the cavity and abutting directly against an underside of the substantially planar top surface for providing support and shock absorption to the substantially planar top surface.

10. The floor panel of claim 9, wherein the shock absorption material is made from one or more materials selected from the group consisting of polypropylene foam, expanded polypropylene foam, polyethylene foam, polystyrene foam, urethane foam, rubber, and processed recycled rubber.

11. The floor panel of claim 9, wherein the top portion is made of one or more material is selected from the group consisting of polypropylene, structural urethane foams, polyolefin, filled plastic, phenolic, stiff rubber, aluminum, metal, and alloys.

12. The floor panel of claim 9, wherein the substantially planar top surface is covered with a material selected from the group consisting of carpet, linoleum, vinyl, wood, synthetic wood, ceramic tile, plastic tile, and artificial turf.

13. The floor panel of claim 9, further comprising a bottom surface interfaced to the side surfaces, thereby encapsulating the bottom support structure.

14. The floor panel of claim 9, wherein at least one of the protrusions has a lip, the lip locking within the receiver of the adjacent floor panel.

15. The floor panel of claim 9, wherein the substantially planar top surface has a first plurality of drainage holes and the bottom support structure has a second plurality of drainage holes corresponding the first plurality of drainage holes.

16. The floor panel of claim 15, wherein a bottom surface of the support structure has drainage troughs interfaced to the second plurality of drainage holes.

17. A floor panel comprising:

a top portion of the floor panel made from one or more materials selected from the group consisting of polypropylene, structural urethane foams, polyolefin, filled plastic, phenolic, stiff rubber, aluminum, metal, and alloys; the top portion having a substantially planar top surface and having side surfaces depending downwardly from edges of the substantially planar top surface forming a cavity beneath the substantially planar top surface, the top portion having means for interlocking situated on at least one of the side surfaces;

a bottom support structure comprised of one or more shock absorption material(s) selected from the group consisting of polypropylene foam, expanded polypropylene foam, polyethylene foam, expanded polyethylene foam, polystyrene foam, expanded polystyrene foam, urethane foam, rubber, and processed recycled rubber, the bottom support structure held within the cavity and abutting directly against an underside of the substantially planar top surface for providing support and shock absorption to the substantially planar top surface.

18. The floor panel of claim 17, further comprising a bottom surface interfaced to the side surfaces, thereby encapsulating the bottom support structure.

19. The floor panel of claim 17, wherein the means for interlocking comprising protrusions and receivers and at least one of the protrusions has a lip, the lip locking within the receiver of a second floor panel.

20. The floor panel of claim 17, wherein the substantially planar top surface has a first plurality of drainage holes and the bottom support structure has a second plurality of drainage holes corresponding the first plurality of drainage holes.

* * * * *